US005473416A

United States Patent [19]

Endou et al.

[11] Patent Number: 5,473,416

[45] Date of Patent: Dec. 5, 1995

[54] DEVELOPING APPARATUS

[75] Inventors: Isao Endou; Satoshi Haneda; Hiroyuki Nomori, all of Hachioji, Japan

[73] Assignee: Konica Corporation, Tokyo, Japan

[21] Appl. No.: 156,080

[22] Filed: Nov. 23, 1993

[30] Foreign Application Priority Data

Dec. 4, 1992 [JP] Japan ..... 4-351039

[51] Int. Cl.[6] ..... G03G 15/09

[52] U.S. Cl. ..... 355/246; 118/647; 355/259; 355/261

[58] Field of Search ..... 355/251, 259, 355/253, 245, 246, 256, 261–263, 265; 118/651, 647, 648, 649

[56] References Cited

U.S. PATENT DOCUMENTS

| | | | |
|---|---|---|---|
| 4,502,061 | 2/1985 | Ando et al. | 346/153.1 |
| 4,697,914 | 10/1987 | Hauser | 118/653 X |
| 4,766,468 | 8/1988 | Hosono et al. | 355/327 |
| 4,930,438 | 6/1990 | Demizu et al. | 118/651 |
| 5,157,226 | 10/1992 | Takahashi | 118/651 |
| 5,166,472 | 11/1992 | Maeda et al. | 118/653 |
| 5,235,388 | 8/1993 | Rimai et al. | 355/246 |
| 5,289,238 | 2/1994 | Lior et al. | 355/256 |
| 5,298,949 | 3/1994 | Yamamoto et al. | 355/246 |

FOREIGN PATENT DOCUMENTS

| | | |
|---|---|---|
| 56-27158A | 3/1981 | Japan . |
| 57-198470A | 12/1982 | Japan . |
| 2-130569A | 5/1990 | Japan . |
| 3-131878A | 6/1991 | Japan . |
| 4-56977A | 2/1992 | Japan . |
| 4-115264A | 4/1992 | Japan . |

*Primary Examiner*—A. T. Grimley
*Assistant Examiner*—Thu A. Dang
*Attorney, Agent, or Firm*—Finnegan, Henderson, Farabow, Garrett & Dunner

[57] ABSTRACT

A developing apparatus includes a control electrode assembly provided in an upstream portion of a developing area of a developing sleeve that is opposed to an image retainer. The control electrode assembly is provided with an insulating member so that it can be located close to the developing sleeve or it can be contacted with the developing sleeve. An end portion of the control electrode is protruded onto a downstream side with respect to an end portion of the insulating member so that a toner cloud can be generated immediately before the developing area.

18 Claims, 23 Drawing Sheets

($W_1 < W_2$)

L1 = 1mm

L1 = 1mm $L_1$ = 1mm

DEVELOPING APPARATUS

BACKGROUND OF THE INVENTION

The present invention relates to a developing apparatus of an electrophotographic type image forming apparatus in which one-component developer composed of nonmagnetic toner particles is used to develop electrostatic latent images.

There is provided a conventional developing apparatus used for an electrophotographic image forming apparatus in which one-component developer composed of nonmagnetic toner particles is used.

In this developing apparatus, toner particles are held on a rough surface of a rotatably supported cylindrical developing sleeve so as to convey the toner particles to a developing area for development. This type of developing apparatus is applied to an image forming apparatus in which non-contact development is conducted. However, in this type of developing apparatus, relatively rough non-magnetic toner particles, the average particle size of which is approximately 10 μm, are generally used for developer. Therefore, delicate lines and contrast can not be accurately reproduced by this developing apparatus. For this reason, this developing apparatus is not suitable for image formation of high quality.

In order to improve image quality in this non-contact development, it is necessary to reduce the size of toner particles so as to provide minute particles. However, when the average size of toner particles is reduced to a value not more than 10 μm, the following problems may be encountered:

(1) A formed image is affected by van der Waals force compared with Coulomb's force in development. Therefore, a phenomenon of fog appears in which toner particles are deposited on a background of the image. In this case, it is difficult to prevent the occurrence of fog even when a DC bias voltage is impressed upon a developing sleeve.

(2) It becomes difficult to control a triboelectric charging operation. Therefore, coagulation of toner particles tends to occur.

(3) Fluidity of toner particles tends to change in accordance with the environment and the condition of use. Accordingly, the image characteristics tend to change in accordance with the change in the fluidity.

For these reasons, improvements in image quality provided when the size of toner particles is reduced are not so effective, and it is difficult to obtain clear images.

In order to solve the aforesaid problems, various developing methods have been proposed until now, which will be described as follows.

(1) Japanese Patent Publication Open to Public Inspection No. 27158/1981

A plurality of corona discharge wires, which are parallel with each other, are provided between an image retainer and a developing sleeve which are not contacted, and the polarities of adjoining wires are set to be reverse. Under the above condition, an AC voltage is impressed so that developer particles are scattered between the image retainer and the developing sleeve.

(2) Japanese Patent Publication Open to Public Inspection No. 198470/1982

A grid is provided between a latent image holding surface and a toner holding surface, and a bias voltage including DC and AC components, or including one of DC and AC components, is impressed between the grid and the toner holding surface.

(3) Japanese Patent Publication Open to Public Inspection No. 131878/1991

There are provided an electrode made of a plate-shaped elastic body, the end portion of which is located in a developing area so as to be contacted with developer on the sleeve, and a voltage impressing means for impressing a variable electric field between the electrode and the sleeve. By the action of the variable electric field, developer is scattered in the developing area so as to develop a latent image.

(4) Japanese Patent Publication Open to Public Inspection No. 130569/1990

In a developing method in which a bias voltage including an AC component is impressed, when the impression of the AC component is stopped, an electrical field to pull the developer particles back to the sleeve side is impressed exceeding a predetermined intensity.

(5) Japanese Patent Publication Open to Public Inspection No. 115264/1992

There is provided a multicolor image developing method in which a plurality of developing apparatus disclosed in Japanese Patent Publication Open to Public Inspection No. 131878/1991 are arranged.

(6) Japanese Patent Publication Open to Public Inspection No. 56977/1992

In the developing method disclosed in Japanese Patent Publication Open to Public Inspection No. 131878/1991, when a developing operation is not conducted, a releasing electrical field is impressed so that the developer particles deposited on the electrode can be released toward the image retainer.

However, the aforesaid developing apparatus and methods of the prior art have various problems.

By the methods of items (1) and (2), development is conducted while an alternating electrical field is impressed by a plurality of grid wires provided between the image retainer and the sleeve in a developing area. In this case, scattered developer particles clog between the wires, so that the developing properties are deteriorated. Also, it is difficult to accurately dispose a plurality of wires in a small gap of a substantial apparatus.

In the method described in item (3), an electrode to scatter developer particles also exists on an upstream side of the contact portion with the sleeve. Accordingly, when developer particles are conveyed, a variable electrical field is formed in the same manner as that of the developing area, so that the developer particles are further returned to the upstream side. As a result, an amount of developer conveyed through the electrode is excessively lowered.

In the methods described in items (4) and (5), in a multicolor image forming apparatus having a plurality of developing apparatus in which the formed toner image is transferred by one operation, fogging toner deposited on the image forming body and toner deposited on a non-image portion of the image forming body tend to be reversely conveyed to the developing apparatus since the electrical potential on the image retainer surface is high.

In the method described in item (6), in a multicolor image forming apparatus in which development is conducted a plurality of times and the formed image is transferred by one operation, toner clouds formed by toner particles released by the releasing electrical field drift in the developing space even when development operations of other colors are conducted. Therefore, mixing of color tends to occur on the image retainer especially when a continuous copying operation is carried out. Moreover, two types of power sources for impressing a voltage upon an electrode, one is for developing and the other is for releasing, are required, so that the structure of the apparatus becomes complicated.

Further, the present invention relates to a method for manufacturing an electrode used for a developing apparatus, and also relates to the developing apparatus. More particularly, the present invention relates to improvements in a control electrode used for a developing apparatus in which toner particles in developer are vibrated so as to be scattered, and the scattered toner particles are deposited on an image retainer drum.

Conventionally, there has been provided a developing apparatus in which toner particles in developer are vibrated so as to be scattered, and the scattered toner particles are deposited on an image retainer drum. In this developing apparatus, powdery toner is generally used, and a cloud is formed of the powdery toner. For this reason, this method is referred to as "a powder cloud developing method".

According to this method, minute toner particles can be used, so that a resolving power higher than that of a conventional method can be provided. As described in items (1), (2) and (3), the following proposal has been made recently: A control wire or a control electrode is attached into a developing region so that a toner cloud is electrically formed to develop toner images by means of cloud-development.

SUMMARY OF THE INVENTION

In view of the points described above, the present invention has been achieved. It is an object of the present invention to provide a developing apparatus characterized in that: a sufficient amount of toner is conveyed to the developing area; the developing efficiency is high; the developing properties are maintained stable over a long period of time; and toner of different color is prevented from entering onto the sleeve so that color mixing can be prevented. Therefore, the developing apparatus of the present invention can be applied not only to a common image forming apparatus but also to a multicolor image forming apparatus in which the formed toner image is transferred by one operation.

Further object of the present invention is to provide a control electrode used for cloud-development characterized in that: (1) the control electrode is accurately disposed in the developing region; (2) and toner particles are scattered by the control electrode only in the developing region. The present invention is to provide a control electrode member for developing apparatus use to accomplish the above object, a method for manufacturing the control electrode, and a developing apparatus to which the control electrode member is applied.

In order to accomplish the above object, the present invention is to provide a developing apparatus comprising: a control electrode assembly provided in an upstream portion of a developing area of a developing sleeve that is opposed to an image forming body, the control electrode assembly being provided with an insulating member so that it can be located close to the developing sleeve or it can be contacted with the developing sleeve, wherein an end portion of the control electrode assembly is protruded onto a downstream side with respect to an end portion of the insulating member so that a toner cloud can be generated immediately before the developing area.

The control electrode assembly is provided with an insulating member on the image forming body side of the electrode portion, so that the control electrode assembly is not contacted with the image forming body (image retainer) for preventing the leakage of an electrical current.

The length of a side end portion on the downstream side of the insulating member on the image forming body side is the same as, or longer than that of an end portion of the insulating member on the developing sleeve side. Therefore, the control electrode assembly is insulated from the image forming body (image retainer), so that the leakage of a current can be positively prevented.

A side end portion on the downstream side of the electrode assembly portion or a side surface is coated with an insulating member, so that an electrical discharge from the electrode to the image forming body can be prevented.

The present invention is to provide a developing apparatus comprising: a control electrode assembly provided in an upstream portion of a developing area of a developing sleeve opposed to an image forming body, the control electrode assembly being provided with an insulating member so that it can be located close to the developing sleeve or it can be contacted with the developing sleeve, wherein the entire electrode portion is located on the downstream side with respect to a position where the developing sleeve and the control electrode are most closely located, so that toner clouds are generated immediately before the developing area, and toner clouds are not generated on the upstream side of the position where the developing sleeve and the control electrode assembly are most closely located.

The control electrode assembly is provided with an insulating member on the image forming body side of the electrode portion, so that the control electrode is not contacted with the image forming body (image retainer) and the leakage of a current can be prevented.

The length of a side end portion on the downstream side of the insulating member on the image forming body side is the same as, or longer than that of an end portion of the insulating member on the developing sleeve side. Therefore, the control electrode is insulated from the image forming body (image retainer), so that the leakage of a current can be positively prevented.

A side end portion on the downstream side of the electrode portion or a side surface is coated with an insulating member, so that an electrical discharge from the electrode to the image forming body can be prevented.

The present invention is to provide a developing apparatus comprising: a control electrode assembly provided upstream of a developing area of a developing sleeve that is opposed to an image forming body, the control electrode assembly being provided through an insulating member so that it can be located close to the developing sleeve or it can be contacted with the developing sleeve, whereby a first oscillating electric field to scatter toner particles between the electrode and the developing sleeve is formed. In this developing apparatus, the following inequality is satisfied:

$$1 \leqq R \cdot f / v \leqq 30$$

where the effective length of the electrode is R on the downstream side with respect to a position where the control electrode and the developing sleeve are located most closely, the surface speed of the developing sleeve is v, and the frequency of the first oscillating electric field is f. Therefore, toner particles can be desirably dispersed and scattered by the oscillating electric field irrespective of a change in the fluidity of toner, and unnecessary triboelectric charging caused when toner particles are excessively vibrated can be avoided.

Also, a second oscillating electric field, the intensity of which is lower than that of the first oscillating electric field, is formed between the developing sleeve and the image forming body, and further a one-way electric field to move toner particles to the image formation body side is formed between the electrode portion and the image forming body. Therefore, a toner cloud generated in the first oscillating electric field is led to the second oscillating electric field side, and toner particles deposited on the image formation body are not attracted to the electrode side.

In this case, the phase of the first oscillating electric field and that of the second oscillating electric field are made to be the same, so that the toner cloud is smoothly led to the second oscillating electric field, and the occurrence of uneven image density can be prevented.

According to the present invention, a control electrode assembly is provided in an upstream portion of a developing area of a developing sleeve opposed to an image forming body, the control electrode assembly being provided with an insulating member so that it can be located close to the developing sleeve or it can be contacted with the developing sleeve. In this case, an AC voltage in which a DC voltage is superimposed is impressed upon the developing sleeve, and a DC voltage higher than the DC voltage impressed upon the developing sleeve is impressed upon the electrode portion of the control electrode. Due to the foregoing, the first oscillating electric field to disperse and scatter toner particles is formed between the electrode portion and the developing sleeve, and at the same time, the second oscillating electric field, the intensity of which is lower than that of the first oscillating electric field, is formed between the developing sleeve and the image forming body. Then, a toner cloud generated close to the first electric field is led to the second oscillating electric field side, so that toner particles are further deposited on the surface of the image forming body.

In this case, when an end portion of the control electrode is protruded to the downstream side as compared with an end portion of the insulating member, the flat, flexible electrode is held by the insulating member which has a sufficient mechanical strength. Accordingly, the first oscillating electric field can be stably generated even in a narrow gap. An amount of gap between the electrode and the developing sleeve is determined by the thickness of the insulating member disposed between the electrode and the developing sleeve. Therefore, a toner cloud formation space can be made in accordance with the gap amount.

When an insulating member is provided on the image formation body side of the electrode, the electrode and the image forming body are insulated, so that a leakage of current caused when the electrode comes into contact with the image forming body (image retainer) can be prevented.

In the case where a side end portion on the downstream side of the insulating member on the image forming body side is located at the same position as that of an end portion of the insulating member on the developing sleeve side, or in the case where the side end portion on the downstream side of the insulating member on the image forming body side is longer than the end portion of the insulating member on the developing sleeve side, the main portion of the electrode located in a toner cloud generating region can be protected from the leakage of current to the image forming body.

In the case where at least the side end portion of the electrode on the downstream side is covered with an insulating member, the occurrence of a discharging phenomenon from the electrode end to the developing sleeve or to the image forming body can be prevented.

In the case where the entire electrode is located on the downstream side of a position where the developing sleeve and the control electrode assembly are provided most closely, a toner cloud is not generated on the upstream side of the aforesaid position. Therefore, a sufficient amount of developer can be supplied to the first oscillating electric field.

In this developing apparatus, the following inequality is satisfied:

$$1 \leqq R \cdot f / v \leqq 30$$

where the effective length of the electrode is R on the downstream side with respect to a position where the control electrode and the developing sleeve are located most closely, the surface speed of the developing sleeve is v, and the frequency of the first oscillating electric field is f. Therefore, toner particles can be vibrated and scattered to the image forming body side, and they are not excessively vibrated so that unnecessary triboelectric charging is not caused. Between the developing sleeve and the image forming body, the second oscillating electric field, the intensity of which is lower than that of the first oscillating electric field, is formed. Therefore, a toner cloud generated in the first oscillating electric field is quickly led to the second oscillating electric field. Between the electrode and the image forming body, the one-way electrode to move toner particles to the image forming body side is formed, and further the phase of the first oscillating electric field and that of the second oscillating electric field are the same. Therefore, the toner particles deposited on the image forming body are not attracted to the electrode side.

The first embodiment of the control electrode of the present invention is an electrode assembly provided in an upstream portion of a developing area of a developing sleeve opposed to an image forming body, the control electrode assembly being provided with an insulating member so that it can be located close to the developing sleeve or it can be contacted with the developing sleeve, wherein the electrode section is formed of an insulating base plate coated with metallic foil.

The second embodiment of the present invention is an electrode assembly composed of an insulating base plate coated with metallic foil, wherein an insulating layer is formed on the electrode of the metallic foil.

The third embodiment of the present invention is an electrode assembly, wherein the insulating layer is made of an insulating resin film.

The fourth embodiment of the present invention is an electrode assembly, wherein the thickness of the control electrode is 0.01 to 1 mm.

The fifth embodiment of the present invention is an electrode assembly, wherein the dielectric constant of the insulating resin film base plate is 2 to 5 at the frequency of 1 MHz.

The sixth embodiment of the present invention is an electrode assembly, wherein the dielectric constant of the insulating resin film base plate and/or the insulating layer is 2 to 5 at the frequency of 1 MHz.

The seventh embodiment of the present invention is an electrode assembly, wherein the length of the electrode section of the control electrode in a circumferential direction is 0.03 to 2 mm.

The eighth embodiment of the present invention is an electrode assembly, wherein the width of the electrode section of the control electrode in the longitudinal direction is larger than that of the developer conveyance region of the developing sleeve in the longitudinal direction.

The ninth embodiment of the present invention is an electrode assembly provided in an upstream portion of a developing area of a developing sleeve opposed to an image forming body, the electrode assembly being provided with an insulating member so that it can be located close to the developing sleeve or it can be contacted with the developing sleeve, wherein the electrode section is formed of an insulating base plate having a conductive ink portion on it.

The tenth embodiment of the present invention is an electrode assembly, wherein the length of the electrode section composed of conductive ink of the control electrode width is 0.01 to 1 mm in a sleeve rotating direction.

The eleventh embodiment of the present invention is an electrode assembly, wherein the length of electrode section composed of conductive ink of the control electrode in the longitudinal direction is larger than that of the developer conveyance region on the developing sleeve in the longitudinal direction.

The twelfth embodiment of the present invention is an electrode assembly, wherein the electrode section composed of conductive ink of the control electrode is coated with an insulating layer.

The thirteenth embodiment of the present invention is an electrode assembly, wherein the insulating layer is an insulating resin film.

The fourteenth embodiment of the present invention is an electrode assembly provided with an electrode section including: a base plate made of insulating material, a portion of the base plate being located close to the developing sleeve or coming into contact with the developing sleeve upstream of the developing region of the developing sleeve opposed to the image forming body; and a conductive member formed on the base plate, the entire conductive member being disposed downstream of the closest position where the base plate and the developing sleeve are located most closely, with respect to the developer conveyance direction.

The fifteenth embodiment of the present invention is an electrode assembly, wherein a surface of the conductive member of the control electrode is coated with insulating material.

The sixteenth embodiment of the present invention is an electrode assembly, wherein the maximum diameter of the conductive member of the control electrode in the sleeve rotating direction is 0.01 to 1 mm.

The seventeenth embodiment of the present invention is an electrode assembly, wherein the maximum diameter of the conductive member of the control electrode in the direction of the image forming body and developing sleeve is 0.01 to 1 mm.

The eighteenth embodiment of the present invention is an electrode assembly, wherein the length of the conductive member of the control electrode in the longitudinal direction is longer than that of the developer conveyance region on the developing sleeve in the longitudinal direction.

The nineteenth embodiment of the present invention is a method for manufacturing a control electrode assembly for developing apparatus use provided with an electrode section including: a base plate made of insulating material, a portion of the base plate being located close to the developing sleeve or coming into contact with the developing sleeve upstream of the developing region of the developing sleeve that is opposed to the image forming body; and an electrode section formed on the base plate, the entire electrode section being disposed downstream of the closest position where the base plate and the developing sleeve are located most closely, with respect to the developer conveyance direction, wherein a piece of insulating metallic foil is adhered onto the base plate made of insulating material, and an unnecessary portion of the metallic foil is removed by means of etching.

The twentieth embodiment of the present invention is a method for manufacturing a control electrode assembly for developing apparatus use provided with an electrode section including: a base plate made of insulating material, a portion of the base plate being located close to the developing sleeve or coming into contact with the developing sleeve upstream of the developing region of the developing sleeve that is opposed to the image forming body; and an electrode section formed on the base plate, the entire electrode section being disposed downstream of the closest position where the base plate and the developing sleeve are located most closely, with respect to the developer conveyance direction, wherein a piece of insulating metallic foil is adhered onto the base plate made of insulating material, and an unnecessary portion of the metallic foil is removed by means of etching, and then an insulating layer is provided on the electrode section.

The twenty first embodiment of the present invention is a method for manufacturing a control electrode assembly for developing apparatus use provided with an electrode section including: a base plate made of insulating material, a portion of the base plate being located close to the developing sleeve or coming into contact with the developing sleeve upstream of the developing region of the developing sleeve that is opposed to the image forming body; and an electrode section formed on the base plate, the entire electrode section being disposed downstream of the closest position where the base plate and the developing sleeve are located most closely, with respect to the developer conveyance direction, wherein conductive ink is printed on the surface of the insulating member so as to form an electrode section.

The twenty second embodiment of the present invention is a method for manufacturing a control electrode assembly for developing apparatus use provided with an electrode section including: a base plate made of insulating material, a portion of the base plate being located close to the developing sleeve or coming into contact with the developing sleeve upstream of the developing region of the developing sleeve that is opposed to the image forming body; and an electrode section formed on the base plate, the entire electrode section being disposed downstream of the closest position where the base plate and the developing sleeve are located most closely, with respect to the developer conveyance direction, wherein the electrode section is formed when a conductive member is fixed to a fore end portion of the base plate made of insulating material.

The twenty third embodiment of the present invention is a developing apparatus provided with a control electrode section for a developing apparatus including: a base plate made of insulating material, a portion of the base plate being located close to the developing sleeve or coming into contact with the developing sleeve upstream of the developing region of the developing sleeve that is opposed to the image forming body; and an electrode section formed on the base plate, the entire electrode section being disposed downstream of the closest position where the base plate and the developing sleeve are located most closely, with respect to the developer conveyance direction, wherein the control electrode section includes an electrode member in which a piece of metallic foil is provided on the base plate made of insulating material.

The twenty fourth embodiment of the present invention is a developing apparatus provided with a control electrode section for a developing apparatus including: a base plate made of insulating material, a portion of the base plate being located close to the developing sleeve or coming into contact with the developing sleeve upstream of the developing region of the developing sleeve that is opposed to the image forming body; and an electrode section formed on the base plate, the entire electrode section being disposed downstream of the closest position where the base plate and the developing sleeve are located most closely, with respect to the developer conveyance direction, wherein the electrode member is composed of an insulating member coated with conductive ink.

The twenty fifth embodiment of the present invention is a developing apparatus provided with a control electrode section for a developing apparatus including: a base plate made of insulating material, la portion of the base plate being located close to the developing sleeve or coming into contact with the developing sleeve upstream of the developing region of the developing sleeve that is opposed to the image forming body; and an electrode section formed on the base plate, the entire electrode section being disposed downstream of the closest position where the base plate and the developing sleeve are located most closely, with respect to the developer conveyance direction, wherein the electrode section is formed when a conductive member is fixed to a fore end portion of the base plate made of insulating material.

BRIEF DESCRIPTION OF THE DRAWINGS

FIG. 10 is a schematic illustration of a fore end portion of the electrode member shown in FIG. 8, wherein FIG. 10 is an enlarged side view.

FIG. 11 is a schematic illustration of the apparatus shown in FIG. 8, wherein FIG. 11 is a perspective view.

FIG. 12 is a schematic illustration of the apparatus shown in FIG. 10, wherein FIG. 12 is a side view showing a fore end portion of the electrode member.

DETAILED DESCRIPTION OF THE PREFERRED EMBODIMENTS

With reference to the accompanying drawings, an example of the present invention will be described as follows.

First, with reference to a sectional view of FIG. 2, a color image forming apparatus having developing means preferable for the developing apparatus of the present invention will be explained as follows.

Figure 2:
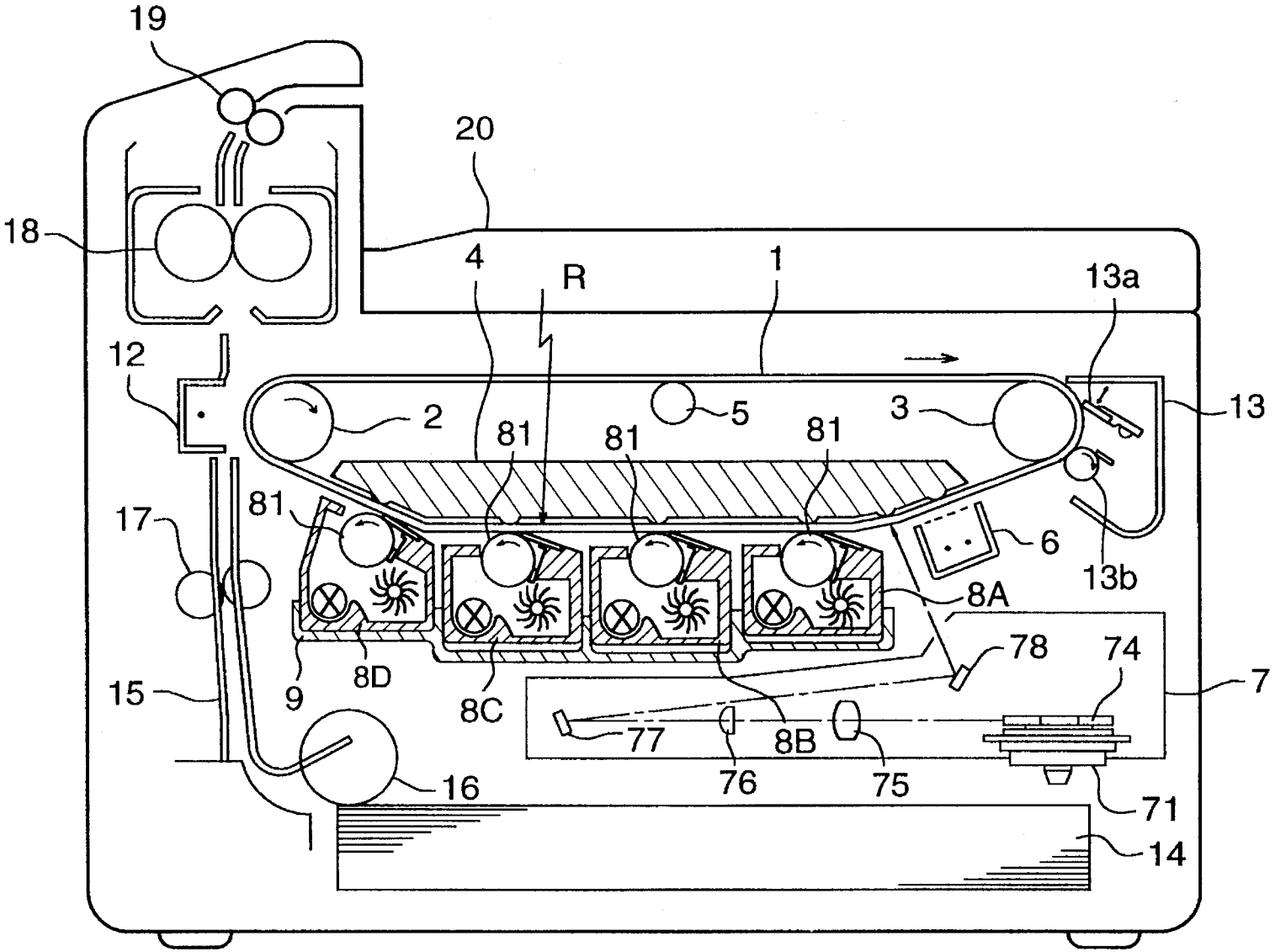
FIG. 2 is a sectional view showing an example of the color image forming apparatus provided with the developing apparatus of the present invention.

In FIG. 2, numeral 1 is an image retainer belt which is a flexible belt-shaped image forming body on which a photoconductor is coated or vapor-deposited. This image retainer belt 1 is provided between rotating rollers 2 and 3, and when the rotating roller 2 is driven, the image retainer belt 1 is conveyed clockwise.

Numeral 4 is a guide member which is fixed to the apparatus body for guiding the image retainer belt 1. When tension is given to the image retainer belt 1 by the action of a tension roller 5, the internal surface of the image retainer belt is slidably contacted with the guide member 4.

Numeral 6 is a scorotron type of charging unit. Numeral 7 is an image exposure section disposed between the charging unit 6 and the developing unit. That is, numeral 7 is an optical writing unit which conducts a writing operation (an exposing operation) with laser beams L. Numerals 8A, 8B, 8C, 8D are a plurality of developing means in which developers of specific colors are accommodated. These are disposed in the position where the guide member 4 comes into contact with the image retainer belt 1.

Further, as described later, a control electrode member according to the present invention is provided.

For example, the aforementioned developing units 8A to 8D accommodate developers of yellow, magenta, cyan and black. The developing units 8A to 8D are provided with developing sleeves 81 which are disposed in such a manner that a predetermined gap is maintained between them and the image retainer belt 1, so that a latent image formed on the image retainer belt 1 can be visualized by means of reversal development under a non-contacting condition. This non-contact developing method is advantageous in that the movement of the image retainer belt 1 is not obstructed, which is different from a contact-developing method. In this connection, the developing apparatus 8A to 8D will be described in detail later.

Numeral 12 is a transfer unit. Numeral 13 is a cleaning unit. While an image is being formed, a blade 13*a* of the cleaning unit 13 and a toner conveyance roller 13*b* are separated from the surface of the image retainer belt 1, and only in a cleaning operation conducted after the image has been formed, the blade 13A and the toner conveyance roller 13B are contacted with the surface of the image retainer belt 1 with pressure.

In the color image forming apparatus described above, a color image forming process is performed in the following manner.

Figure 4:
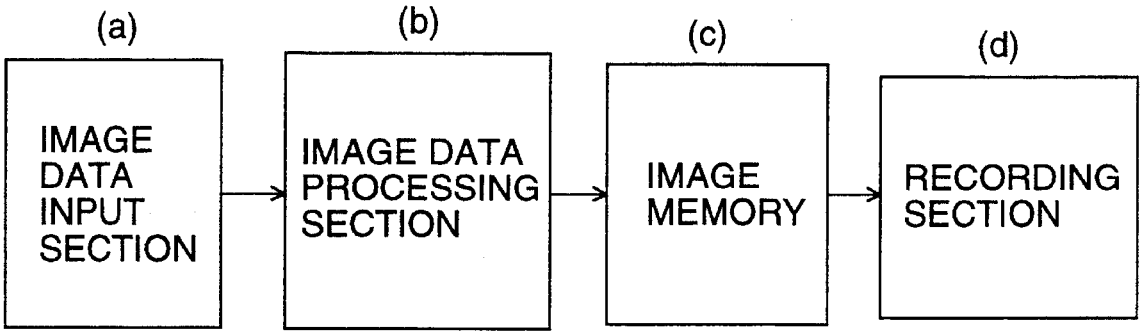
FIG. 4 is a block diagram showing an image formation system.

Multicolor image formation is carried out in accordance with the image formation system in FIG. 4 in this example. First, an original image is provided by the image data input section (a) in which an image sensor conducts a scanning operation, and the data is subjected to a calculating operation in the image data processing section (b) so that image data can be made. Then the image data is temporarily stored in the image memory (c). When recording is conducted, the image data is taken out from the image memory (c), and inputted into the color image forming apparatus shown in FIG. 2 which serves as a recording section (d).

When image data of each color, which is outputted from an image reading unit provided separately from the aforementioned color image forming apparatus, is inputted into optical writing unit 7, laser beams generated by a laser diode, not shown, pass through a collimator lens and a cylindrical lens and are subjected to rotary scanning by a rotary polygonal mirror 74 rotated by a drive motor 71. Then, the laser beams pass through an fθ lens 75 and a cylindrical lens 76 while the optical path of laser beams is curved by mirrors 77 and 78 and laser beams are projected on the circumferential surface of the image retainer belt 1 on which a uniform electrical charge is previously given, so that primary scanning is carried out and a bright line is formed.

When a scanning operation is started, laser beams are detected by an index sensor not shown in the drawing. Laser beams modulated according to the image data of the first color, scan the circumferential surface of the image retainer belt 1. Consequently, a latent image corresponding to the first color is formed on the circumferential surface of the image retainer belt 1 by the action of primary scanning conducted by laser beams and auxiliary scanning conducted by the conveyance of the image retainer belt 1. This latent image is developed by a developing unit 8A loaded with yellow (Y) toner, so that a toner image is formed on the circumferential surface of the image retainer belt 1. While the obtained toner image is maintained on the surface of the image retainer belt 1, it passes below a blade 13*a* of the cleaning unit 13 which has been separated from the surface of the image retainer belt 1. Then, the process advances to the next image forming cycle.

That is, the image retainer belt 1 is charged again by the charging unit 6, and image data of the second color outputted from the image data processing section is inputted into the optical writing unit 7, and then the image data of the second color is written onto the circumferential surface of the image retainer belt 1 in the same manner as the first color so that a latent image is formed. The latent image is developed by the developing unit 8B loaded with magenta (M) toner.

The magenta (M) toner image is formed under the presence of the yellow (Y) toner image.

Numeral 8C is a developing unit provided with cyan (C) toner, and a cyan (C) toner image is formed on the belt surface according to a control signal generated by the image data processing section.

Numeral 8D is a developing unit provided with black toner, and a black toner image is formed and superimposed on the belt surface in the same manner. DC bias and/or AC bias is impressed upon each sleeve of the developing units 8A to 8D, and noncontact developing is conducted by two-component developer which is an image visualizing means, so that the toner image on the image retainer belt 1, the base of which is grounded, is developed.

High voltage, the polarity of which is reverse to that of toner, is impressed upon the color toner image formed on the circumferential surface of the image retainer belt 1, and the toner image is transferred in the transfer section onto a transfer sheet which has been sent from a paper feed cassette 14 through a paper feed guide 16.

That is, the uppermost transfer sheet in the paper feed cassette 14 is conveyed out from the paper feed cassette 14 by the rotation of the paper feed roller 16, and supplied to the transfer unit 12 through a timing roller 17 in synchronization with image formation conducted on the image retainer belt 1.

The transfer sheet onto which an image is transferred, is positively separated from the image retainer belt 1, the conveyance direction of which is sharply changed when it is rotated around the rotating roller 2. Then, the transfer sheet is conveyed upward. After that, the image on the image retainer belt 1 is fixed by a fixing roller 18, and discharged onto a tray 20 by a discharge roller 19.

After the image has been transferred onto the transfer sheet, the image retainer belt 1 is further rotated, and residual toner on the belt is removed by the cleaning unit 13, the blade 13*a* and the toner conveyance roller 13*b* of which are contacted with the surface of the belt with pressure. After the cleaning operation has been completed, the aforementioned blade 13*a* is separated again from the belt surface, and a little after that, the toner conveyance roller 13*b* is separated so that a new image forming process is started.

In this example, the developing apparatus of the present invention is applied to a color image forming apparatus provided with a belt-shaped image carrier. However, it should be noted that the developing apparatus of the present invention can be applied to a color image forming apparatus provided with a drum-shaped image carrier.

Next, the developing apparatus described above will be explained in detail. The developing apparatus 8A to 8D are constructed in the same manner, so that they will be represented by numeral 8, hereinafter.

Figure 1:
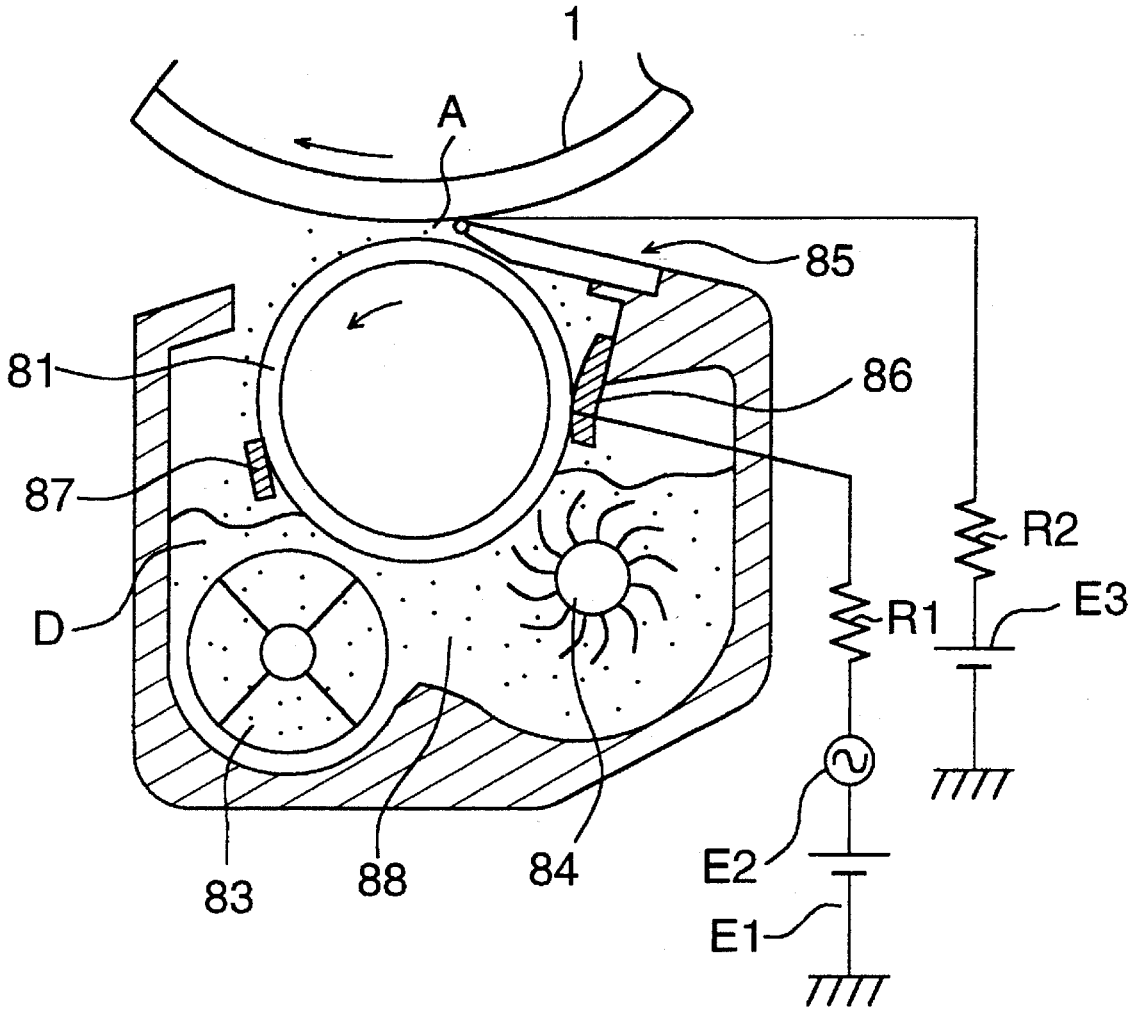
FIG. 1 is a sectional view showing an example of the developing apparatus of the present invention.

FIG. 1 is a sectional view showing an outline of the developing apparatus applied to an example of the present invention. In FIG. 1, numeral 81 is a rotatable developing sleeve made of nonmagnetic material such as aluminum and stainless steel, and the surface of the developing sleeve 81 has been subjected to sand blasting so that the surface roughness is 1 to 2 μm according to the expression of surface roughness of JIS-B0610. Numeral 83 is a stirring unit for stirring developer D to make the component uniform. Numeral 84 is a fur brush for supplying developer D to the developing sleeve 81. Numeral 86 is a regulating blade made of rubber for regulating the thickness of a developer layer on the developing sleeve 81.

In this case, the structure of a control electrode 85 will be described as follows, wherein the control electrode 85 is disposed close to the developing sleeve 81 or contacted with it.

The control electrode assembly 85 is provided for generating the first oscillating electric field to form a toner cloud upstream of a developing region. The control electrode assembly 85 includes a control electrode 85*a* disposed close to the surface of the developing sleeve 81 through an insulating member 85*b* made of rubber. Alternatively, the control electrode 85*a* is contacted with the surface of the developing sleeve 81 through the insulating member 85*b*.

Figure 6:
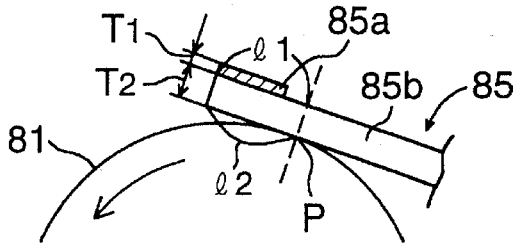
FIGS. 6(*a*) to 6(*h*) are views showing the examples of a control electrode in the case where the entire electrode is disposed on the downstream side of the closest position.
Figure 6:
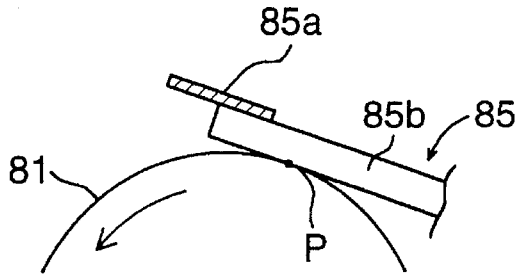
Figure 6:
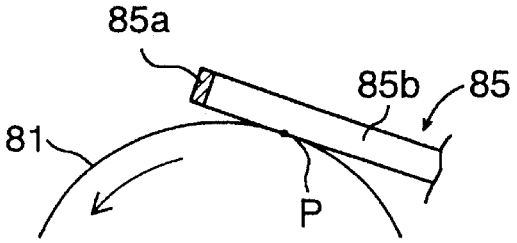
Figure 6:
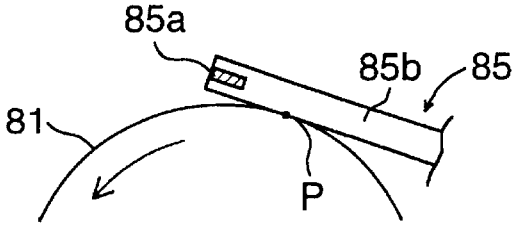
Figure 6:
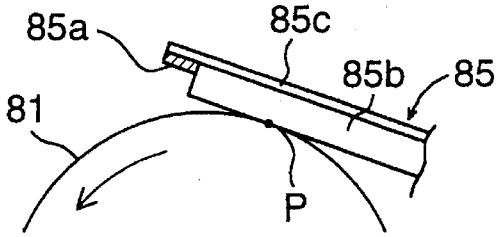
Figure 6:
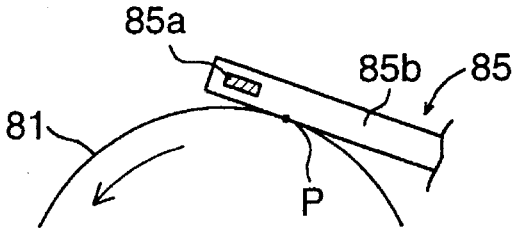
Figure 6:
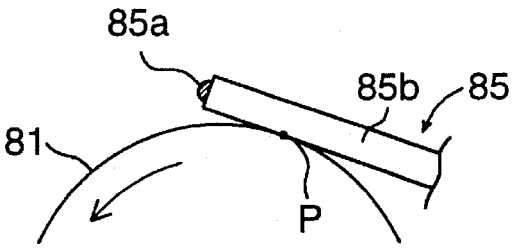
Figure 6:
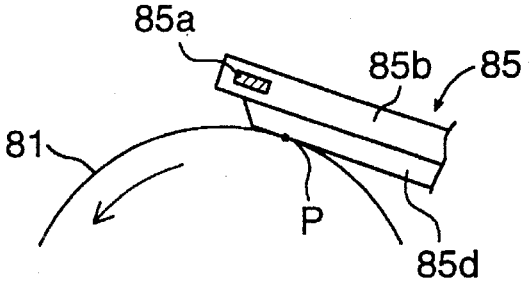

FIGS. 6(*a*) to 6(*h*) show examples in which the entire electrode 85*a* is disposed on the downstream side of a point P. In this case, the point P represents a position where the developing sleeve 81 and the insulating member 85*b* are disposed most closely. In these examples, the electrode is not provided on the upstream side of the point P, so that an oscillating electric field is not generated at all. Consequently, the occurrence of a toner cloud is prevented in the upstream, so that the stoppage of developer supply to the downstream side of point P can be prevented.

In these examples, the electrode 85*a* may be attached to either of the upper side, end portion or the lower side of the insulating member 85*b* as illustrated in FIGS. 6(*a*), 6(*b*), 6(*c*) and 6(*e*). Alternatively, the electrode 85*a* may be embedded in the lower end portion of the insulating member 85*b* as illustrated in FIGS. 6(*d*), 6(*f*), and 6(*h*). Also, the sectional configuration of the electrode 85*a* is not necessarily rectangular. For example, a wire, the section of which is circular, may be attached to the fore end portion of the insulating member 85*b* so as to form the electrode 85*a* as illustrated in FIG. 6(*g*). In this case, the wire is supported by the insulating member 85*b*, which is a strength member, so that the wire can be stably provided in a narrow gap between the image forming body and the developing sleeve. Therefore, as compared with a case in which the wire is independently attached, it is possible to accurately position the wire in the case described above. In this connection, the wire may be covered with an insulating layer.

In this connection, on the developing sleeve 81 side, a lower side of the end portion of the control electrode 85 assembly (the electrode 85*a* and the insulating member 85*b*) may be cut away into a V-shape so that a toner cloud can be generated in a space between the control electrode assembly 85 and the developing sleeve 81.

A reinforcing plate 85*d* may be attached to the insulating member 85*b* on the developing sleeve side as shown in FIG. 6(*h*) so that a sufficient volume of toner cloud generation space can be formed.

When the developing sleeve 81 is rotated, a layer of developer D, the thickness of which is regulated by the control electrode assembly 85, is conveyed to the development region A. In this connection, the control electrode assembly 85 can work as a regulating blade to regulate the thickness of a developer layer on the developing sleeve 81.

In this case, the control electrode assemblies 85 in the examples shown in FIGS. 6(*a*) to 6(*h*) is improved in the following manner:

(a) An insulating member 85*c* is provided on the image retainer (image forming body) 1 side.

(b) Length of the downstream side end portion of the insulating member 85*c* on the image retainer 1 side is the same as or longer than the end portion of the insulating member 85*b* on the developing sleeve 81 side.

(c) At least the downstream side end portion of the electrode 85*a* is covered with the insulating member.

Concerning the electrodes shown in FIGS. 6(*a*) to 6(*h*), for the purposes of ensuring a toner cloud generation space, for preventing the vibration in the case of toner cloud formation and improving the accuracy of positioning, a reinforcing plate may be attached to the developing sleeve side insulating member 85*b*, and the developing sleeve side insulating member 85*b* may be formed from a material, the hardness of which is higher than that of the image forming body side insulating member 85*c*.

In order to manufacture the electrodes described above, the following methods may be employed: an etching method commonly used for producing printed boards; a method in which a conductive layer is dip-coated or printed on an insulating board; a vapor-deposition method; and a CVD method. From the viewpoint of accuracy and productivity, the etching method is preferably used.

Further, exposed portions of the electrodes shown in FIGS. 6(*a*) to 6(*h*) are preferably coated with an insulating layer, the thickness of which is 10 to 100 μm. Due to the foregoing, breakdown of the electrode with respect to the developing sleeve and image forming body can be prevented, so that a high electric potential can be maintained.

Figure 3:
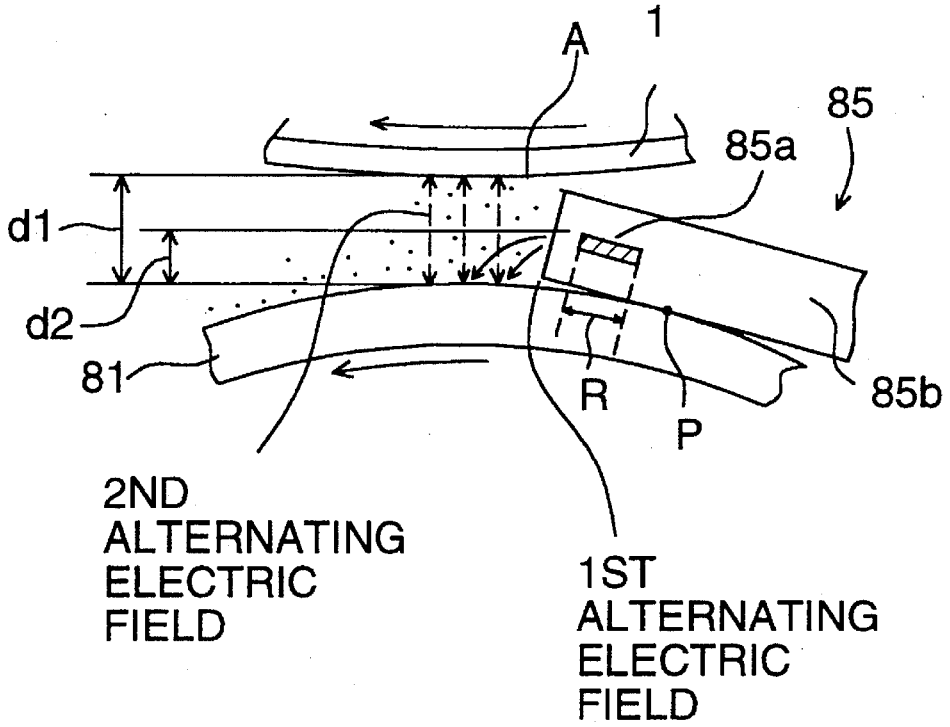
FIGS. 3(*a*) and 3(*b*) are schematic illustrations of a toner cloud generating section.
Figure 3:
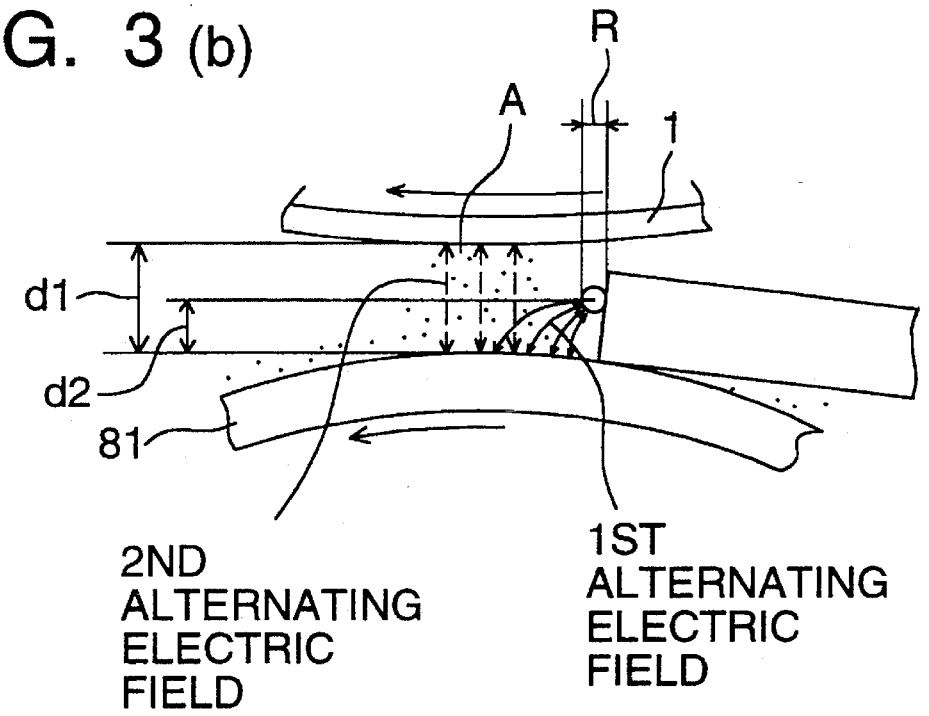

With reference to FIGS. 3(*a*) and 3(*b*) showing a toner cloud generating section, drive conditions of the control electrode will be explained as follows.

The control electrode assembly 85 is constructed in such a manner that the following inequality is satisfied:

$$1 \leqq R \cdot f \leqq 30 \quad (1)$$

where R (mm) is the effective length of the electrode 85*a* on the downstream side of the point P where the control assembly 85 is arranged most closely to the developing sleeve 81, v (mm/sec) is the surface speed of the developing sleeve 81, and the frequency of the first oscillating electric field is f (Hz).

In this case, the effective length of the electrode 85*a* is the length of an electric region which directly contributes to the formation of the first oscillating electric field although the effective length depends on the thickness and insulating characteristics of the insulating member 85*b* on the lower side (developing sleeve side). The effective length R of the electrode 85*a* is defined as a distance between the closest point P and the end of the electrode 85*a*, wherein the distance is measured in a tangential direction of the developing sleeve 81.

Specifically, a preferable construction can be provided by the following condition.

$0.03 \leqq R \leqq 3$ f=0.3 to 10 (KHz)

v=50 to 500 (mm/sec)

It is preferable that the aforementioned inequality (1) is satisfied under the above condition.

In the example illustrated in FIG. 6(*f*) in which the entire electrode is coated with an insulating layer, the effective length is the same as the length from the closest point P to the end of the electrode on the downstream side.

The following inequality represents a condition by which developer D can be sufficiently vibrated so as to be scattered from the developing sleeve 81 to the image retainer 1.

$$1 \leqq R \cdot f/v \quad (1a)$$

The following inequality represents a condition by which the occurrence of a phenomenon described below can be prevented. In the phenomenon, the developer D is vibrated so intensely that an excessive amount of triboelectric charge is given to toner particles, and the electrostatic adhesive force is increased too high and the particles are not sufficiently scattered to the image retainer 1 from the developing sleeve 81.

$$R \cdot f/v \leqq 30 \quad (1a)$$

When the electrode 85*a* is driven while the above two inequalities are satisfied, a highly efficient image formation can be realized without causing unevenness and defect in the formed image.

In this connection, it is preferable that the aforementioned two inequalities are replaced with the following inequality.

$$2 \leqq R \cdot f/v \leqq 10 \quad (2)$$

In order to stably generate a toner cloud, it is preferable that the following inequality is satisfied:

$$1.0 < l_1 < 4.0 \text{(mm)}$$

where $l_1$ (mm) is a distance from the closest point P to the end of the electrode arranged downstream of the point P as shown in FIGS. 6(*a*) to 6(*h*). Also, a distance $l_2$ from the point P to the end of the insulating member 85*b* on the developing sleeve side preferably satisfies the following inequality for the purpose of maintaining the linearity of the electrode and ensuring the setting accuracy of the electrode in the case where the electrode section including the electrode and insulating member comes into contact with the developing sleeve.

$$0.1 < l_2 < 3.0 \text{(mm)}$$

Further, when an inequality of $l_1 > l_2$ is satisfied, the electrode section can be set highly accurately and a sufficient volume of toner cloud generating region can be ensured. Also, it is preferable that the thickness $T_1$ of the electrode section 85*a* is 10 to 200 μm, the thickness $T_2$ of the insulating members 85*b*, 85*c* is 20 to 200 μm, and further an inequality of $0.3T_1 \leqq T_2 \leqq 4T1$ is satisfied.

In this example, the control electrode assembly 85 is driven under the aforesaid condition, and the second oscillating electric field, the intensity of which is lower than that of the first oscillating field, is formed between the developing sleeve 81 and the image retainer 1 (image forming body), and the one-way electric field to move toner particles to the image retainer 1 side is also formed between the electrode section 85*a* and the image retainer 1. An object of forming the second oscillating electric field, the intensity of which is lower than that of the first oscillating electric field, is to guide a toner cloud generated in the first oscillating electric field to the development region on the downstream side without extinction. Another object of forming the second oscillating electric field is to facilitate a toner cloud to adhere to the image retainer 1, and further to prevent the deposited developer from being attracted to the electrode section 85*a* side.

According to the present invention, the phase of the first oscillating electric field and that of the second oscillating electric field are made to be the same by using a common electric power source. The reason is as follows. When the phase of the first oscillating electric field and that of the second oscillating electric field are different, a toner cloud is not smoothly guided. As a result, the density of a developed image becomes uneven. In order to prevent the occurrence of unevenness, both phases are made to be the same.

In order to separate a developer layer formed on the developing sleeve 81 from the surface of the image retainer belt 1 so as to form a predetermined gap, a gap between the developing sleeve 81 and the control electrode 85 is adjusted, and also a gap between the developing sleeve 81 and the image retainer belt 1 is adjusted. Numeral 87 is a cleaning blade to remove the developer that has passed through the developing region A, from the developing sleeve 81. Numeral 88 is a developer reservoir, and numeral 89 is a casing.

A bias voltage in which a DC and an AC component are superimposed is impressed upon the developing sleeve 81 through the protective resistance R1, wherein the DC component is supplied by the DC bias voltage power source El, and the AC component is supplied by the AC bias voltage power source E2. A DC bias voltage is impressed upon the electrode section 85*a* of the control electrode 85 by the DC bias voltage E3 through the protective resistance R2.

Figure 5:
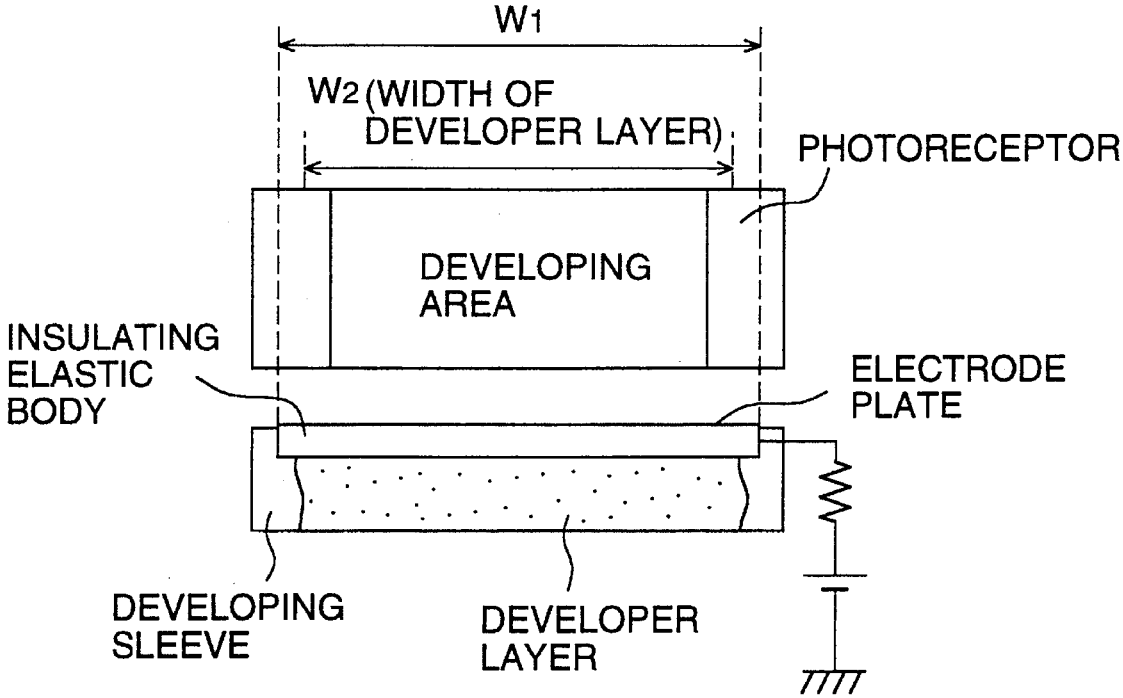
FIG. 5 is a schematic illustration showing the circumstances in which the development region of an image retainer and a developing sleeve is illustrated.

As shown in FIGS. 3(*a*) and 3(*b*), as well as in the enlarged sectional views of FIGS. 1 and 5 showing the developing region A and its vicinity, a bias voltage in which a DC and an AC component are superimposed is impressed upon the developing sleeve 81, and a DC bias voltage is impressed upon the control electrode 85. In the aforesaid color image forming apparatus, an OPC image retainer, which is negatively charged, is used for the image retainer belt 1 and reversal development is performed. For example, when the image retainer is charged at −800 V, a DC voltage of −700 to −1000 V, the absolute value of which is larger than that of the image retainer potential, is impressed upon the control electrode assembly 85, and a bias voltage including a DC and an AC component is impressed upon the developing sleeve 81. The frequency of the AC component is 100 Hz to 10 kHz, and preferably 4 kHz. The peak to peak voltage is 200 to 4000 V, and preferably 1 kV.

Due to the foregoing, a bias voltage, the absolute value of which is larger than that of the developing sleeve 81, is impressed upon the electrode section 85*a* of the control electrode assembly 85. Accordingly, toner particles are not deposited on the control electrode section 85*a*, and even in an overlapping process, a toner image on the image retainer belt 1 is not deposited on the electrode section 85*a*. Whereas the electrode section 85*a* is disposed close to the development sleeve 81 as compared with the image retainer belt 1. Therefore, the intensity of the first oscillating electric field is higher than that of the second oscillating electric field.

It is preferable that the closest gap $d_2$ between the electrode section 85*a* and the developing sleeve 81 maintains the following relation with respect to the closest gap $d_1$ between the image retainer belt 1 and the developing sleeve 81.

$$d_2=(0.2 \text{ to } 0.6)d_1$$

In this case, $d_1$ is 0.2 to 1.0 mm. Whereas the electrode is disposed in a small development region, it is preferable that an angle θ formed between the opposing position of the developing sleeve 81 and the image retainer belt 1, and the electrode section 85*a*, is 5° to 45° on the upstream side. It is preferable that the diameter of the developing sleeve is 10 to 30 mm. Further, a ratio $V_s/V_p$ of the moving speed $V_s$(mm/sec) of the developing sleeve to the moving speed $V_p$ (mm/sec) of the image forming body is preferably 0.5 to 2.0.

$$V_s/V_p=0.5 \text{ to } 2.0$$

As illustrated in FIG. 5, the longitudinal width $W_1$ of the electrode section 85*a* is larger than the width $W_2$ of the developer layer on the developing sleeve. A DC voltage is impressed by the power source E3 upon a position on the electrode section 85*a* outside of the region $W_2$. Therefore, the occurrence of an unnecessary toner cloud can be restricted at a position except for the electrode section.

The first oscillating electric field oscillates the toner particles in a direction perpendicular to the lines of electric force generated by the electric field. Therefore, the toner particles are scattered and a toner cloud can be sufficiently produced. By the action of the second oscillating electric field, this toner cloud is helped to advance to a latent image on the image retainer belt 1, so that development is uniformly performed.

In this case, it is important that the phase of the first oscillating electric field and that of the second oscillating electric field are the same. Whereas both phases are the same, development can be smoothly performed without causing a surge of toner oscillation. When the phases are the same, the occurrence of dielectric breakdown can be prevented which is caused by an intense electric field generated when the phase is changed.

The wave form of the AC voltage component is not limited to a sine wave, but it may be a rectangular or a triangular wave. The higher the voltage the AC component is, the more the toner particles are oscillated, although the oscillation depends on the frequency. On the other hand, dielectric breakdown such as fogging and lightning tends to occur. In this case, the occurrence of fog can be prevented by the DC voltage component, and the occurrence of dielectric breakdown can be prevented when the surface of the developing sleeve 81 is coated with a layer of resin or an oxide film, or when the surface of the developing sleeve 81 is coated with a semi-insulating layer.

As described above, an image of high quality can be developed by the developing apparatus of the present invention in the following manner: While a one-component developer layer is disposed in a noncontact condition with respect to the image retainer belt 1 which an image carrier (image forming body), a toner cloud is generated by the action of the first and second oscillating electric field, so that the toner particles are facilitated to scatter toward the image retainer belt 1. Therefore, the toner particles are selectively attracted onto an electrostatic image. Accordingly, it is possible to use minute toner particles, and an image of high quality can be provided.

In the image forming apparatus of the present invention, a developer containing the following nonmagnetic toner is preferably used.

In general, when the average size of toner particles is reduced, the charging amount is reduced proportional to the square of the reduced particle size. Relatively, an adhesive force such as van der Waals force is increased, so that the particles intensely adhere onto the surface of the developing sleeve 81, and tend to scatter toward the non-image portion. As a result, fog tends to occur. According to the conventional developer layer developing method, when the average particle size is lowered to a value not more than 10 μm, the aforesaid problems are remarkably caused.

In order to solve the problems, the present invention employs a method in which development is performed with a developer layer under the presence of double oscillating electric fields. That is, toner particles are intensely oscillated in the first oscillating electric field and separated from the developing sleeve 81 so that a toner cloud is formed. Then the toner particles in the cloud is conveyed to the developing region A located closely to the toner cloud. Then the toner particles are faithfully attracted onto an electrostatic latent image in the second oscillating electric field, the intensity of which is lower than that of the first oscillating electric field. Also, toner particles, the electric charging amount of which is small, are barely moved to the image and non-image portions. Further the toner particles are not rubbed by the image retainer belt, so that they are not attracted by the action of triboelectricity. In this way, small toner particles, the diameter of which is approximately 1 μm, can be applied to the developing apparatus.

As described before, in the case where the average size of toner particles is increased, image quality is deteriorated. Usually, in the case of a developing operation in which resolving power of 10 lines/mm is maintained, toner particles of which the average particle size is 20 μm can be used. However, when minute toner particles of which the average particle size is 1 to 5 μm are used, the resolving power is remarkably improved, and an image of high quality in which the contrast is faithfully reproduced can be provided. For this reason, the appropriate average toner particle size is not more than 10 μm, and preferably 1 to 5 μm. In order to move the toner particles in accordance with the intensity of the electric field, it is preferably that the charging amount of toner particles is larger than 1 to 3 μC/g, and more preferably it is 3 to 30 μC/g. Especially when minute particles are used, a large amount of electric charging is required.

The minute toner particles described above can be provided by the same method as that of conventional toner particles. In other words, the toner particles are used which are provided in the following manner. The toner particles obtained by the conventional methods of crushing, suspension polymerization and emulsion polymerization are selected by an average particle size selection means.

A preferable toner for the developing apparatus of the present invention can be produced in the following manner, A resin such as styrene resin, vinyl resin, ethylene resin, rosin denatured resin, acrylic resin, polyamide resin, epoxy resin and polyester resin, and a resin of fatty acid wax such as palmitic acid and stearic acid, are used. A color pigment and if necessary a charging control agent are added to the resin. Then toner particles are produced by the conventional methods of crushing, suspension polymerization and emulsion polymerization. The average particle size is not more than 20 μm, preferably not more than 10 μm, and more preferably 1 to 7 μm.

A developer composed of non-magnetic toner particles described above is preferably used for the developing apparatus of the present invention. When necessary, a fluidity accelerating agent to accelerate the fluidity of toner particles, and a cleaning agent to clean the image carrier surface are mixed with the developer. Examples of usable fluidity accelerating agents are: colloidal silica, hydrophobic titania, silicon varnish, metallic soap, and non-ion surface active agent. Examples of usable cleaning agents are surface active agents such as fatty acid metallic slat, organic group substitution silicon, and fluorine.

In the experiments made by the inventors, non-magnetic particles provided in the following manner were used for the aforesaid developing apparatus. The non-magnetic particles included 100 weight parts of styrene acrylic resin (Hymer up 100 manufactured by Sanyo Kasei Co.), and 10 weight parts of color pigment. The non-magnetic particles of which the particles size was 5 μm were made by the crushing pelletization method. Development was performed with a developing apparatus shown in FIG. 1. In this case, the average charging amount of toner was −5 μC/g.

Experiments were made using an image forming apparatus shown in FIG. 2 to which the aforesaid developing apparatus was assembled. The experimental conditions were as follows:

Circumferential speed: 180 mm/sec

Maximum voltage of an electrostatic latent image formed on the image retainer belt 1: −800 V Outer diameter of the developing sleeve 81: 300 mm Rotational speed: 150 rpm Thickness of developer layer D: 0.03 mm Gap formed between the developing sleeve 81 and the image retainer belt 1: 0.7 mm The following bias voltage was impressed upon the developing sleeve 81:

DC voltage component: −700 V

AC voltage component: 4 kHz

Peak to peak voltage: 1000 V

Distance from the electrode section 85*a* to the image retainer belt 1: 0.4 mm Effective length R of the electrode section 85a: 4 mm Impressed voltage: −1000 V In this example, developer D on the developing sleeve 81 was not contacted with the surface of the image retainer belt 1. Under the above conditions, development was conducted, and the developed image was transferred onto a transfer sheet of regular paper by means of corona discharge. Then the developed image was fixed by a fixing unit including a heat roller, the temperature of which was 140° C. As a result, an excellent clear recorded image of high quality was provided without causing edge or fog. Successively, the recording operation was conducted on 50000 sheets of paper. As a result, stable constant recorded images were provided from the beginning to the end.

In the above example, while a specific developing apparatus was being operated, the developing sleeves of other developing apparatus were stopped, and at the same time the AC bias voltage to be impressed upon the developing sleeves was not supplied. That is, the bias in the condition of floating was impressed, or the bias of the same polarity as that of toner or the bias of the different polarity from that of toner was impressed. In this connection, a voltage of the same polarity as that of toner was maintained at the electrode section of the control electrode. Due to the foregoing, movement of toner from the toner image on the image retainer to the electrode member was prevented.

In this example, the control electrode was composed in the following manner:

A polyimide piece of 50 μm thickness was used for the insulating members 85*c*, 85*b*. The electrode section 85*a* was made by the etching method using a copper foil of 40 μm thickness, and a reinforcing plate 85*d* of 200 μm thickness made of glass epoxy was attached to the electrode section 85*a*. The configuration is illustrated in FIG. 6(*h*).

Figure 7:
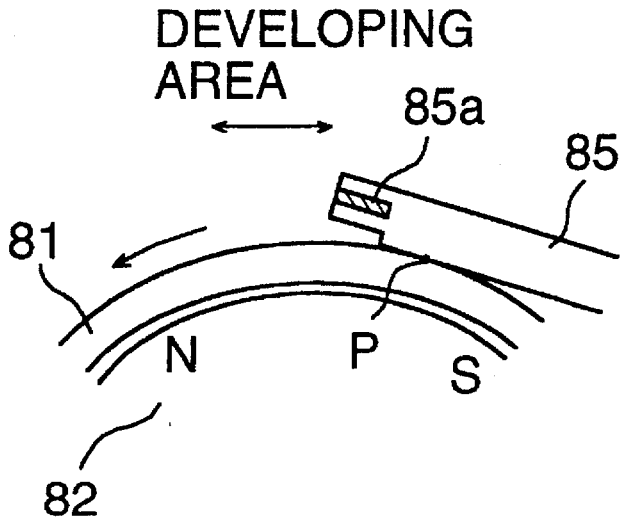
FIGS. 7(*a*) and 7(*b*) are sectional views showing an example in which the present invention is applied to a developing apparatus provided with two-component developer.
Figure 7:
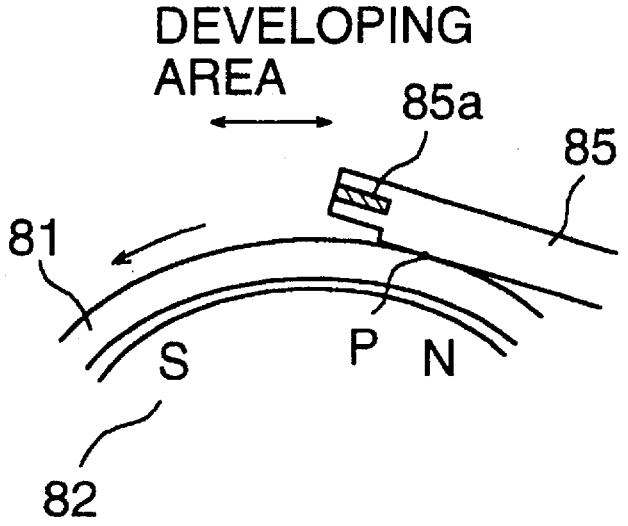

FIGS. 7(*a*) and 7(*b*) are schematic illustrations showing an outline of another example in which the control electrode of the present invention is applied to a developing apparatus using two-component developer. In the above description of the present invention, the developing apparatus using one-component developer is taken for an example, however, the present invention can be also applied to a developing apparatus in which two-component developer containing magnetic carrier and toner is used.

In FIGS. 7(*a*) and 7(*b*), numeral 81 is a developing sleeve made of non-magnetic material such as aluminum, and numeral 82 is a magnet fixed inside the developing sleeve, the magnet being provided with a plurality of N and S poles on its surface. The developing sleeve 81 and magnet 82 compose a two component developer conveyance carrier. The developing sleeve 81 can be rotated with respect to the magnet 82, and an arrow in the drawing shows a rotational direction of the developing sleeve 81. On the surface of the developing sleeve 81, a developer layer including magnetic carrier and toner, that is, a magnetic brush is formed. When the developing sleeve 81 is rotated, the magnetic brush is moved in the same direction as that of the developing sleeve 81, and conveyed to the developing region. In this case, as shown in FIGS. 7(*a*) and 7(*b*), N and S magnetic poles are disposed on both sides of the closest point P where the electrode member assembly 85 is located most closely to the developing sleeve 81. Due to the foregoing construction, the developer layer can be made uniform by the electrode member assembly 85, and toner cloud generation is conducted.

As described above, according to the developing apparatus of the present invention, an electrode disposed close to the developing sleeve or capable of coming into contact with the developing sleeve through an insulating member is provided in an upstream portion of the developing sleeve opposed to the image forming body, wherein an end portion of the electrode is protruded to a downstream side with respect to an end portion of the insulating member. Therefore, a stable toner cloud can be generated immediately before the developing region.

The aforesaid electrode is provided with an insulating member on the image forming body side, so that an electric current leakage is not caused since the electrode is insulated from the image forming body.

Since the length of the downstream side end portion of the insulating member on the image forming body side is the same as or longer than that of the end portion of the insulating member on the developing sleeve side, the electrode is insulated from the image forming body (image retainer), so that an electric current leakage can be positively prevented.

Also, the downstream side end portion of the electrode and the side of the electrode are covered with the insulating member. Therefore, the occurrence of a discharging phenomena can be prevented.

According to the developing apparatus of the present invention, an electrode assembly disposed close to the developing sleeve or capable of coming into contact with the developing sleeve through an insulating member is provided in an upstream portion of the developing sleeve opposed to the image forming body, wherein the entire electrode section of the assembly is placed downstream with respect to the closest position where the developing sleeve and the control electrode are located most closely. Accordingly, a toner cloud is generated immediately before the developing region. Further, a toner cloud is not generated upstream of the closest position of the developing sleeve and the control electrode.

The electrode assembly is provided with an insulating member on the image forming body side, so that an electric current leakage is not caused since the electrode assembly is insulated from the image forming body.

Since the length of the downstream side end portion of the insulating member on the image forming body side is the same as or longer than that of the end portion of the insulating member on the developing sleeve side, the electrode assembly is insulated from the image forming body (image retainer), so that an electric current leakage can be positively prevented.

Also, the downstream side end portion of the electrode assembly and the side of the electrode are covered with the insulating member. Therefore, the occurrence of a discharging phenomena can be prevented.

According to the developing apparatus of the present invention, an electrode assembly disposed close to the developing sleeve or capable of coming into contact with the developing sleeve through an insulating member is provided in an upstream portion of the developing sleeve opposed to the image forming body, wherein the first oscillating electric field is generated for scattering toner particles between the electrode section and the developing sleeve. In the aforesaid developing apparatus, the control electrode is constructed in such a manner that the following inequality is satisfied:

$$1 \leqq R \cdot f \leqq 30 \quad (1)$$

where R (mm) is the effective length of the electrode on the downstream side of the point where the control electrode is arranged most closely to the developing sleeve, v (mm/sec) is the surface speed of the developing sleeve, and the frequency of the first oscillating electric field is f (Hz). Accordingly, an oscillating electric field sufficient for dispersing and scattering toner particles can be formed. Further, the toner particles are not excessively oscillated, so that unnecessary triboelectric charging can be avoided.

The second oscillating electric field, the intensity of which is lower than that of the first oscillating field, is formed between the developing sleeve and the image retainer (image forming body). The one-way electric field is formed to move toner particles to the image retainer side between the electrode section and the image retainer. Therefore, a toner cloud generated in the first oscillating electric field can be led to the second oscillating electric field side, and at the same time the toner particles deposited on the image forming body can not be returned to the electrode side.

Since the phase of the first oscillating electric field and that of the second oscillating electric field are the same, the formed toner cloud is not affected by a surge of toner oscillation. Therefore, an excellent image without unevenness of density can be developed.

Figure 8:
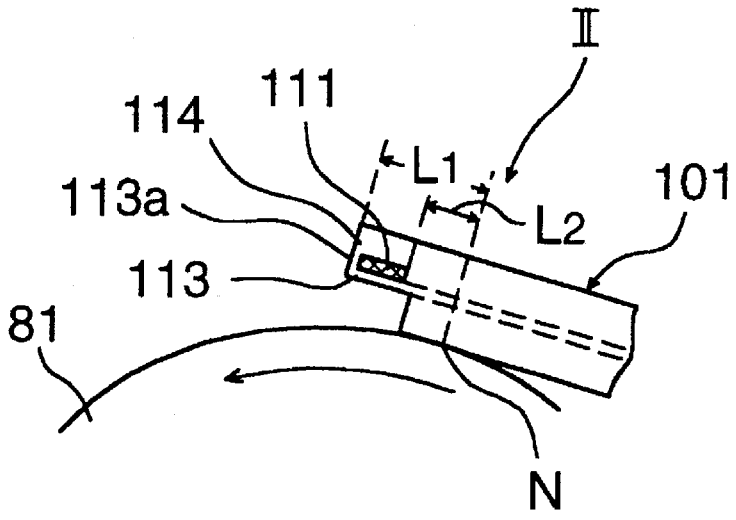
FIG. 8 is a schematic illustration showing the electrode member of the present invention.

The construction of the electrode assembly of the present invention will be explained in further detail. First, the invention in which the electrode assembly is made of metallic foil will be explained as follows. An example of the electrode assembly of the present invention is shown in FIG. 8, wherein FIG. 8 is a side view showing a positional relation between the electrode assembly 101 and the developing sleeve 81. As illustrated in FIG. 8, the electrode assembly 101 includes: a base plate 113 made of insulating material, a portion of which is disposed close to the developing sleeve 81 made of stainless steel or aluminum, or a portion of which comes into contact with the developing sleeve 81, wherein the closest position between the electrode member 101 and the developing sleeve 81 is designated by N; and an electrode section 111 made of metallic foil disposed downstream of the developer conveyance direction with respect to the closest position N where the electrode member 101 and the developing sleeve 81 are most closely disposed.

As illustrated in FIG. 8, $L_1$ designates a distance between a fore end of the electrode member 101 and the closest position N, and $L_2$ designates a distance between a rear end of the electrode section 111 and the closest position N.

As a result of the foregoing, the electrode section 111 does not exist upstream of the developing region, so that the formation of an alternating electric field can be avoided in the upstream of the developing region. In this case, for example, the developing region is a region designated by character A illustrated in FIGS. 26(*a*) and 26(*b*) showing the construction of the developing apparatus. Therefore, a problem in which an amount of developer conveyed to the developing region is lowered can be avoided, so that a clear image can be formed with a sufficient amount of developer.

It is not necessarily easy to dispose the entire electrode member 111 downstream of the developer conveyance direction with respect to the closest position N between the base plate 113 and the developing sleeve 81 as described above. However, according to the present invention, when the electrode section 111 is made of metallic foil, the entire electrode member 111 can be easily disposed downstream of the closest position N and satisfactory effects can be provided.

In the present invention, the electrode section 111 made of metallic foil may be covered with an insulating layer 114. In the present invention, the insulating base plate or the insulating layer may be made of insulating resin film.

The relative dielectric constant of the insulating base plate or the insulating layer is preferably 1.5 to 5 at the frequency of 1 MHz. In the case where the relative dielectric constant is not more than 1.5, the alternating electric field is not sufficiently high in the fore end portion of the control electrode, so that sufficient developing properties can not be provided. On the contrary, in the case where the relative dielectric constant is not less than 5, the intensity of the alternating electric field is increased too high, and the image quality tends to be deteriorated.

Figure 9:
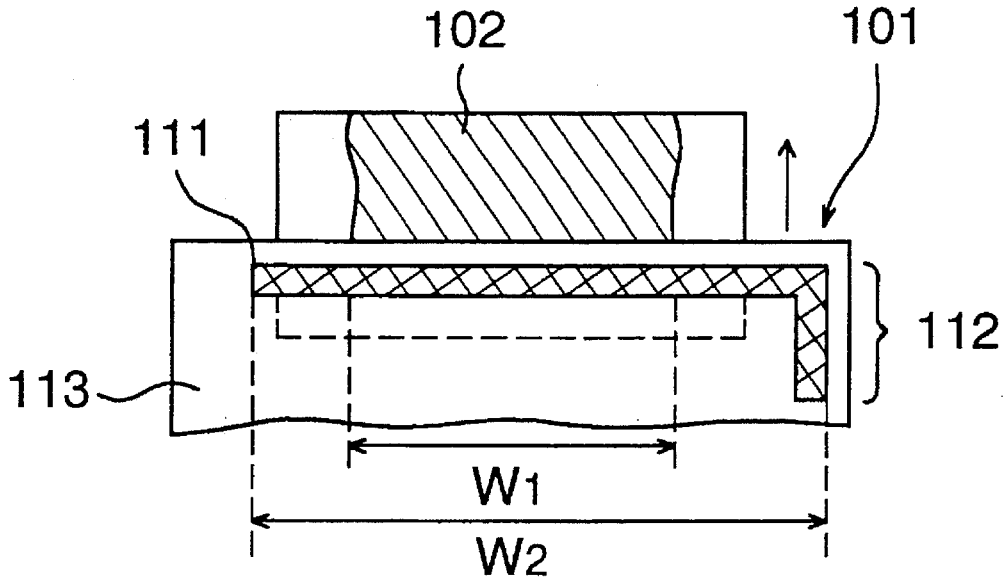
FIG. 9 is an enlarged schematic illustration taken along line 9—9 in FIG. 8.
Figure 10:
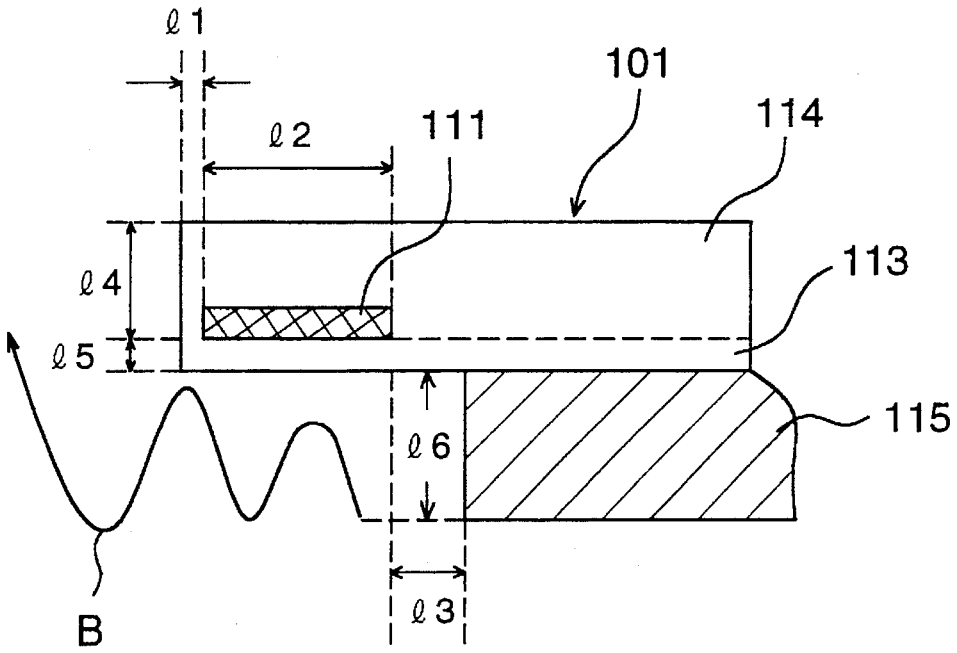
Figure 11:
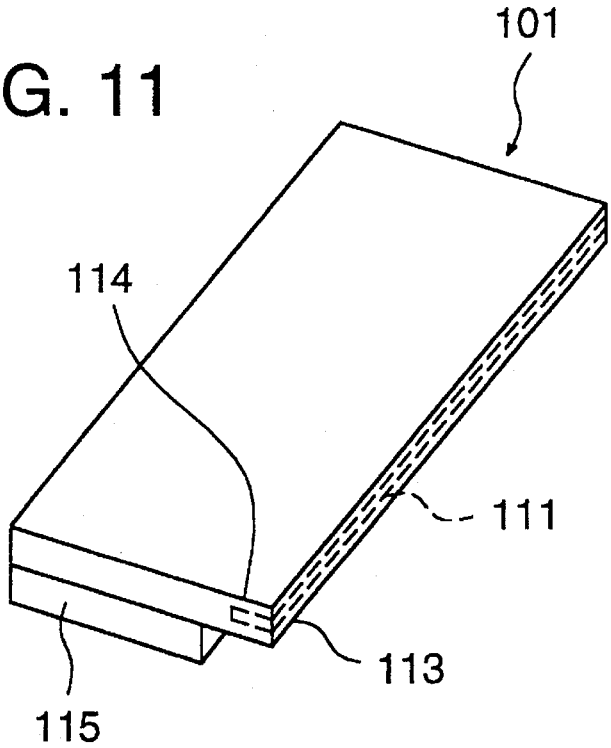

With reference to FIGS. 9 and 10, the present invention will be described in further detail. In this case, FIG. 9 is an enlarged view taken from line 9—9 in FIG. 8, and FIG. 10 is an enlarged side view of the fore end portion of the electrode assembly 101. Length $l_2$ (shown in FIG. 10) of the electrode section 111 in the rotational direction of the developing sleeve is preferably 0.03 to 2 mm, and more preferably 0.05 to 1 mm. In this case, the rotational direction of the sleeve 3 is shown in FIG. 8.

In the case where the length $l_2$ is not more than 0.03 mm, the developing properties tend to be lowered due to insufficient toner oscillation. A model of the toner oscillating region is represented by character B illustrated in FIG. 10. In the case where the length $l_2$ is not less than 2 mm, the toner particles are oscillated too intensely resulting in overcharge, and the developing properties are deteriorated. Further, it becomes difficult to dispose the electrode section 111 only in the downstream of the closest position N between the insulating base plate 113 and the developing sleeve 81, which is the characteristic construction of the present invention. Length $L_1$ between the closest position N and the fore end 113*a* on the downstream side of the control electrode assembly 101 is preferably 0.02 to 5 mm (shown in FIG. 8).

Width of the electrode section in the longitudinal direction is preferably larger than that of the developer conveyance region on the developing sleeve. That is, the width $W_2$ of the electrode section 111 of the control electrode 101 is preferably larger than the width $W_1$ of the developer conveyance region 102 determined by the area of the developer layer so that the inequality of $W_1<W_2$ can be satisfied. Also, as illustrated in FIG. 9, a terminal section 112 may be formed outside the developer conveyance region 102. Due to the foregoing, the occurrence of a redundant toner cloud can be prevented, and also the apparatus can be maintained clean, and further color mixture can be avoided. In the example shown in FIG. 8, the electrode section 111 is formed into an L-shape at the edge of the base plate 113 so as to form the terminal section 112. In this way, $W_2$ can be made large.

Figure 12:
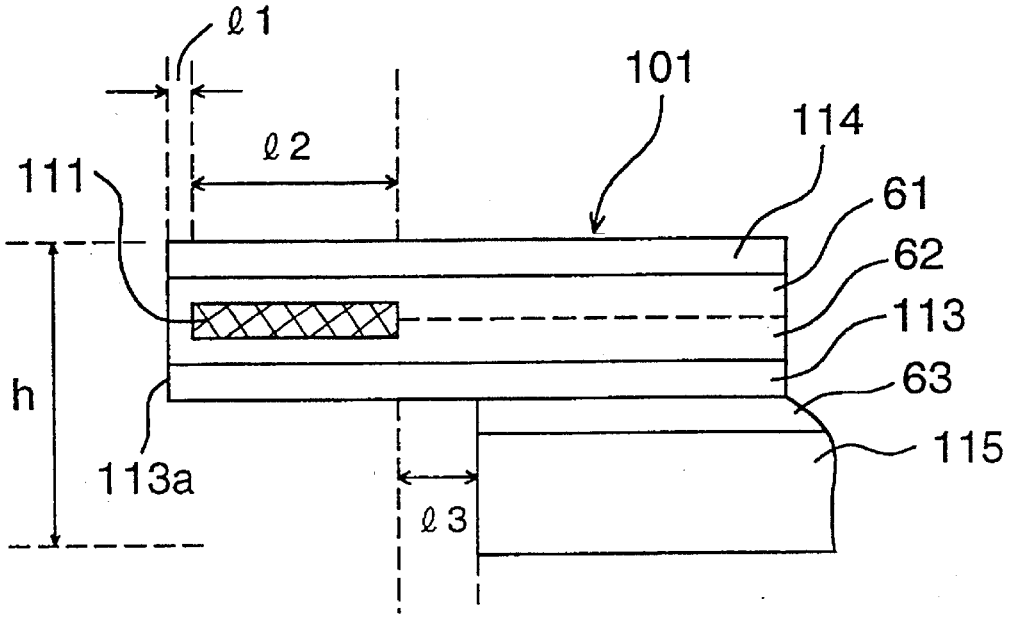
Figure 13:
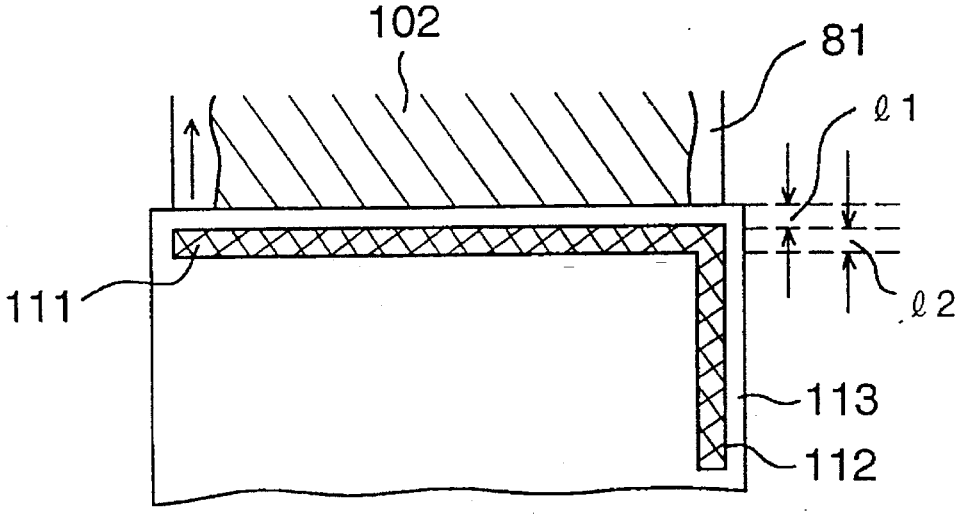
FIG. 13 is a schematic illustration for explaining the construction of the apparatus shown in FIG. 12.

A setting position of the downstream side end portion of the electrode assembly 101 is illustrated in FIG. 12 which is an enlarged view of the fore end portion shown in FIG. 10. As illustrated in FIGS. 12 and 13, the setting position of the downstream side end portion of the electrode assembly 101 is preferably located at a position separate from a fore end portion of the insulating base plate 113 of the downstream side by $l_1$=0 to 0.5 mm on the upstream side, and more preferably 0.1 to 0.5 mm, and further more preferably by $l_1$=0.05 to 0.2 mm on the upstream side. In this example shown in FIG. 12, a reinforcing plate 115 is provided so as to reinforce the electrode section. However, it is possible that the reinforcing plate 115 is not provided. In the case where this $l_1$ is not more than 0, that is, in the case where a piece of metallic foil such as copper foil composing the electrode section 111 is protruded, the current leakage tends to occur, and further problems are caused in the mechanical strength. In the case where $l_1$ is not less than 0.5 mm, a toner scattering space is blocked by the metallic foil, and the developing properties are deteriorated.

In order to reinforce the control electrode and ensure the toner scattering space, the reinforcing plate 115 may be adhered onto a lower layer of the base plate 113, or onto an upper or a lower layer of the metallic foil or the insulating layer 114 composing the electrode section 111. In order to avoid the deterioration of developing properties and further in order to ensure the toner scattering space, the reinforcing plate may be provided on a lower layer of the base plate 113 at a position separate from an end portion of the electrode section on the upstream side by $l_3$=0 to 1 mm, and preferably $l_3$ =0 to 0.5 mm (shown in FIGS. 10 and 12). In the case where $l_3$ is not more than 0, the developing properties are deteriorated, and in the case where $l_3$ is not less than 1 mm, the reinforcing effect can not be sufficiently provided, and oscillation caused by the alternating electric field can not be prevented.

The entire thickness h of the control assembly 101 is preferably 0.1 to 1 mm, and more preferably 0.2 to 0.5 mm (shown in FIG. 12).

In the case where the entire thickness of the control electrode is not more than 0.1 mm, the mechanical strength is low, and in the case where the entire thickness of the control electrode is not less than 1 mm, the control electrode is difficult to be inserted into a developing gap.

When the electrode member 111 is made of metallic foil, it can be made in the same manner as that used when a printer board is made.

The insulating base plate 113 may be made of an insulating film which satisfies the conditions of the insulating properties (the volume resistivity is preferably not less than $10^{10}$ Ω·cm, and more preferably not less than $10^{14}$ Ω), heat-resistance, dimension stability, and antibending properties.

The relative dielectric coefficient of the insulating base plate 113 is preferably 1.5 to 5 (MHz). In the case where the relative dielectric coefficient of the insulating base plate 113 is not more than 1.5, the intensity of the alternating electric field can not be increased, so that sufficient developing properties can not be provided. On the contrary, in the case where-the relative dielectric coefficient of the insulating base plate 113 is not less than 5, the intensity of the alternating electric field is increased too high, and the image quality is deteriorated.

Examples of usable materials for the insulating base plate 113 are: polyester, polyimide, glass epoxy, ethylene-4-ethylene fluoride copolymer, 4-ethylene fluoride-6-propylene fluoride copolymer, poly 4-ethylene fluoride, polyamideimide, polysulsulfone, triazine resin, and polyethylene terephthalate. Particularly, a sheet of glass epoxy, which is thin and has a high resilient strength, is preferably used.

It is also possible to use a base plate made of inorganic material such as ceramics, glass and alumina.

Not less than 2 of the aforesaid materials may be combined so as to be used for the base material.

Thickness $l_5$ of the base plate (shown in FIGS. 10 and 12) is preferably 0.01 to 0.5 mm, and more preferably 0.02 to 0.3 mm. The length $l_2$ of electrode section 111 in FIGS. 12 and 13 is 0.03 to 2 mm.

Various metals can be used for the electrode section 111, and typically copper foil can be used.

Electrolytic copper foil, annealed electrolytic copper foil, and beryllium copper foil may be used. From the viewpoint of manufacturing cost and flexibility, annealed copper foil is preferably used.

Thickness of the metallic foil is preferably 0.01 to 0.1 mm, and more preferably 0.02 to 0.06 mm.

For the purpose of ensuring electric insulating properties, corrosion prevention, surface protection, and improvement in the entire electrode, an insulating layer 114 may be provided on the electrode member 111 as illustrated in FIGS. 10 and 12. When the insulating layer 114 is provided, the conductive portion becomes an intermediate layer of the adhered insulating members. Therefore, various stresses given to the electrode section from the outside can be minimized.

When the insulating layer 114 is provided, it is preferable that the material is basically the same as that of the insulating base plate 113 for the purpose of making the entire characteristics the same.

Instead of providing a coated layer of insulating resin, insulating ink may be printed on the electrode so as to form the insulating layer 114.

Thickness $l_4$ of the insulating layer 114 (shown in FIGS. 10 and 12) is preferably 0.01 to 0.5 mm, and more preferably 0.02 to 0.3 mm.

The electrode section made of metallic foil according to the present invention can be manufactured by a printed board manufacturing method of the prior art. A specific manufacturing method employed for the present invention will be briefly described as follows.

A piece of metallic foil for forming the electrode member is adhered in the following manner. There are provided adhesive means in which an adhesive agent is used, and means for fusing the base plate and metallic foil under pressure at high temperature, wherein an adhesive agent is not used. Either means can be applied. In the case where the means using an adhesive agent is employed, a wide selection of materials for base plate 13 can be attained. Further, it is preferable to employ the means using an adhesive agent from the viewpoint of reduction of residual stress and improvements in electric insulating properties and mechanical strength.

Examples of usable liquid adhesive agents are: polyethylisocyanate, phenol resin-butyral, phenol resin-nitrile rubber, and denatured epoxyresin. Examples of usable dry film type adhesive agents are: phenol-butyral, denatured epoxyresin, epoxy-nylon-denatured polyethylene, and FEP Teflon.

In the case where the aforesaid liquid adhesive agent is employed, it is coated on a base plate by means of brushing, spraying, doctor-blade, or roll-coating, and then dried by a drier so as to be hardened. After that, a piece of metallic foil such as copper foil is attached onto the surface with pressure.

In the case where the dry film type adhesive agent is used, it is inserted between the base plate and the metallic foil, and pressed at high temperature with a press machine.

In order to form a registration on a metallic foil corresponding to the electrode portion, the following methods of the prior art can be applied: a photo-etching method in which a conventional photo-polymer is used; and an etching registration method in which screen printing is employed. The photo-etching method is advantageous in improving accuracy.

Various materials can be arbitrarily used for the registration material applied to the photo-etching method. For example, either the conventional positive type or the negative type can be applied.

Examples of usable negative type registration materials are:fish glue-bichromate, polyvinylalchol-diazo type, acetate, polycinnamic acid vinyl, cyclized rubber-azide, polyvinylalcohol-diazo type, acrylic type, polyvinyl cinnamilidene acetate, polycinnamic acid vinyl-β-vinyloxiethyl ester, and azide polymer.

An example of usable positive type registration is o-naphthoquinone diazido type registration.

When a registration of the electrode portion is formed, it is preferable that the length of the registration of the sleeve rotating direction is 0.03 to 2 mm, and more preferably 0.05 to 1 mm. The reason is that toner particles are appropriately oscillated and the developing properties can be improved. In the case where the length is not more than 0.03 mm, toner particles are not appropriately oscillated, so that the developing properties tend to be deteriorated. Therefore, it becomes difficult to dispose the electrode section 111 only in the downstream of the closest position N of the control electrode and the developing sleeve, which is the characteristic construction of the present invention. It is preferable that the closest position N is disposed at a position separate from the fore end of the control electrode on the downstream side by $L_1$=0.02 to 5 mm.

Concerning the width of the electrode portion in the longitudinal direction, it is preferable that the registration is formed to be larger than the developer conveyance region on the developing sleeve. As described above, and as illustrated in FIG. 9, it is preferable that the width $W_2$ of the electrodes 101, 111 is larger than the width $W_1$ of the developer conveyance region 102 determined by the developer layer so that the inequality of $W_1<W_2$ can be satisfied. It is also preferable that the terminal section 112 for impressing voltage is provided outside of the developer conveyance region 102. Due to the foregoing, the generation of a redundant toner cloud is prevented, and the apparatus can be kept clean, so that color mixture can be prevented. Therefore, the aforesaid registration structure is preferably employed.

A setting position of the electrode assembly 101 on the downstream side is preferably set at a position which is located in the upstream of the end portion of the base plate 113, wherein the distance $l_1$ is set to be preferably 0 to 0.5 mm, and more preferably 0.05 to 0.2 mm. In the case where this $l_1$ is not more than 0, that is, in the case where a piece of metallic foil composing the electrode section is protruded, the current leakage tends to occur, and further problems are caused in the mechanical strength. In the case where $l_1$ is not less than 0.5 mm, a toner scattering space is blocked by the metallic foil, and the developing properties are deteriorated.

In the case where $l_1$ is 0, the fore end portion of the electrode 111 is exposed. Therefore, the fore end portion of the electrode on the downstream side is preferably coated with an insulating layer for the purpose of preventing discharge.

Etching processing can be performed in the following manner. In this case, the etching operation of copper foil, which is a typical metallic foil, will be explained here.

Copper foil is removed by means of etching from a portion except for the portion where registration is printed corresponding to the electrode portion. Examples of usable etching liquids are: chloride type etching liquid such as ferric chloride and cupric chloride; and peroxide type etching liquid such as ammonium persulfuric acid and chloric acid.

In the case where an insulating layer is provided on the electrode section 111 as illustrated in FIG. 10, the same material and adhesive agent used in the aforementioned case in which the electrode is attached can be used to form the insulating layer 114. Alternatively, insulating ink may be coated on the electrode as described above.

In order to reinforce the control electrode and ensure the toner scattering space, the reinforcing plate may be adhered onto a lower layer of the base plate 113, or onto an upper layer of the electrode layer or the insulating layer. In this case, the same material as that of other insulating members may be used for the reinforcing plate.

In order to avoid the deterioration of developing properties and further in order to ensure the toner scattering space, the reinforcing plate may be provided on a lower layer of the base plate at a position separate from an end portion of the electrode section on the upstream side by $l_3$=0 to 1 mm, and preferably $l_3$=0 to 0.5 mm (shown in FIGS. 10). In the case where $l_3$ is not more than 0, the developing properties are deteriorated, and in the case where $l_3$ is not less than 1 mm, the reinforcing effect can not be sufficiently provided, and oscillation caused by the alternating electric field can not be prevented.

As illustrated in FIG. 10, the thickness $l_6$ of the reinforcing plate is preferably 0.03 to 0.7 mm, and more preferably 0.05 to 0.5 mm.

According to the present invention, the following developing method may be employed:

Developer is conveyed onto the surface of a developing sleeve, and developing is performed in an oscillating electric field when toner particles are scattered. A control electrode assembly is contacted with the developing sleeve or disposed at a position close to the developing sleeve in the upstream of the developing region. The first oscillating electric field is formed between the electrode member of the control electrode and the developing sleeve, and the second oscillating electric field is formed between the image retainer and the developing sleeve. For example, the intensity of the first oscillating electric field is set higher than that of the second oscillating electric field. Further, an electric field to move the toner particles to the image retainer is formed between the image retainer and the developing sleeve. At this time, the oscillating electric fields are formed between the developing sleeve and the image retainer, and also formed between the developing sleeve and the electrode, and a one-way electric field is formed between the image retainer and the electrode.

Figure 14:
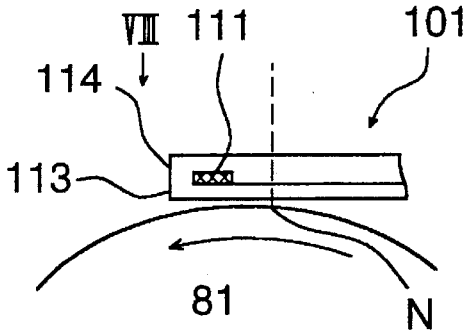
FIGS. 14(*a*) and 14(*b*) are schematic illustrations showing another construction of the electrode member of the present invention.
Figure 14:
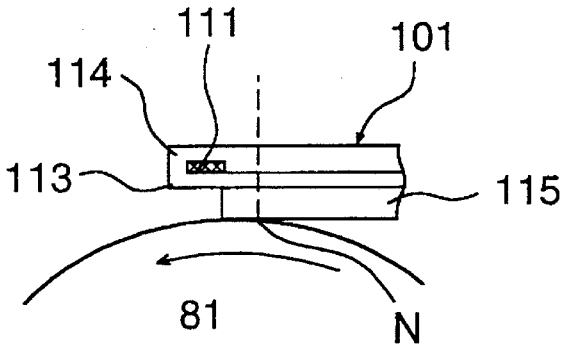
Figure 15:
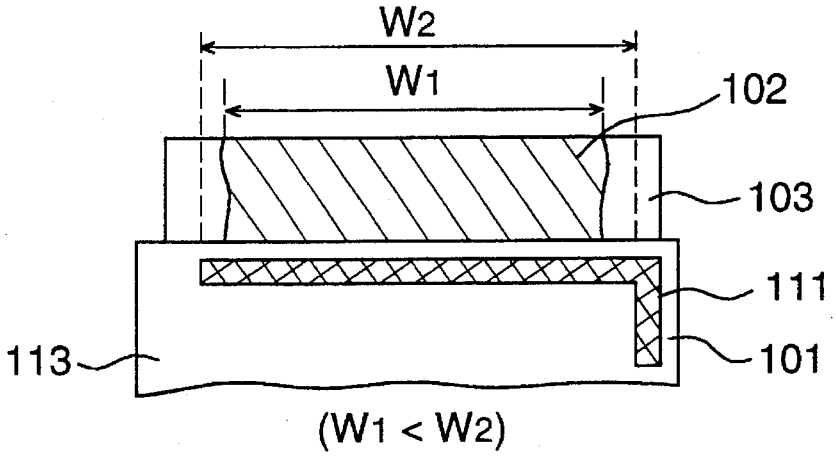
FIG. 15 is another schematic illustration showing the construction of FIGS. 14(*a*) and 14(*b*).

Next, the present invention in which an electrode is formed of a conductive ink layer will be explained as follows with reference to FIGS. 14(*a*), 14(*b*), 15, 16(*a*) and 16(*b*).

As illustrated in FIGS. 14(A) and 14(B), this invention is to provide a developing apparatus provided with a control electrode assembly for a developing apparatus including: a base plate 113 made of insulating material, a portion of the base plate 113 being located close to the developing sleeve 81 or coming into contact with the developing sleeve 81 in the upstream of the developing region of the developing sleeve 81 opposed to the image forming body; and an electrode section 111 formed on the base plate 113, the entire electrode section being disposed in the downstream of the closest position N where the base plate 113 and the developing sleeve 81 are located most closely, with respect to the developer conveyance direction, wherein the electrode member 111 is composed of an insulating ink layer.

As a result of the foregoing, the electrode section 111 does not exist in the upstream of the developing region. Accordingly, the same alternating electric field as that of developing region (designated by character A in FIGS. 26(*a*) and 26(*b*)) is not formed in the upstream of the developing region. Therefore, an amount of developer conveyed to the developing region is not lowered. Accordingly, clear images can be formed by a sufficient amount of developer.

It is not necessarily easy to dispose the entire electrode member 111 at a position downstream of the closest position N between the base plate 113 and the developing sleeve 81. However, according to the present invention, when the electrode section 111 is formed of a conductive ink layer, the aforesaid construction can be simply and easily provided.

In this invention, the relative dielectric constant of the insulating base plate 113 used for the control electrode is preferably 1.5 to 5.

Figure 16:
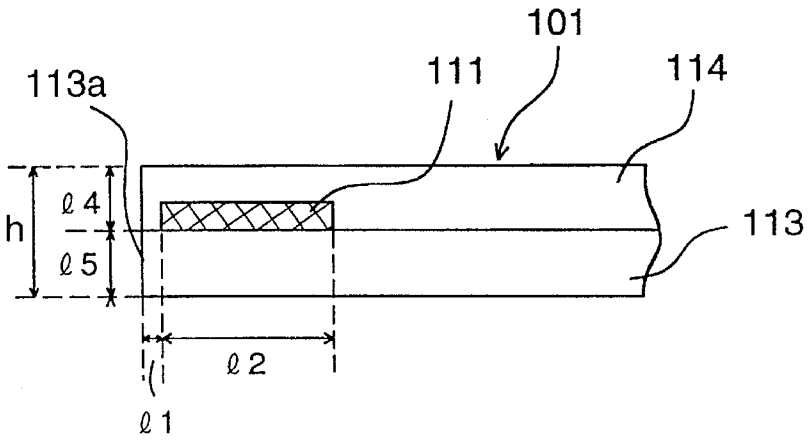
FIGS. 16(*a*) and 16(*b*) are other schematic illustrations of FIGS. 14(*a*) and 14(*b*), wherein FIGS. 16(*a*) and 16(*b*) are enlarged side views.
Figure 16:
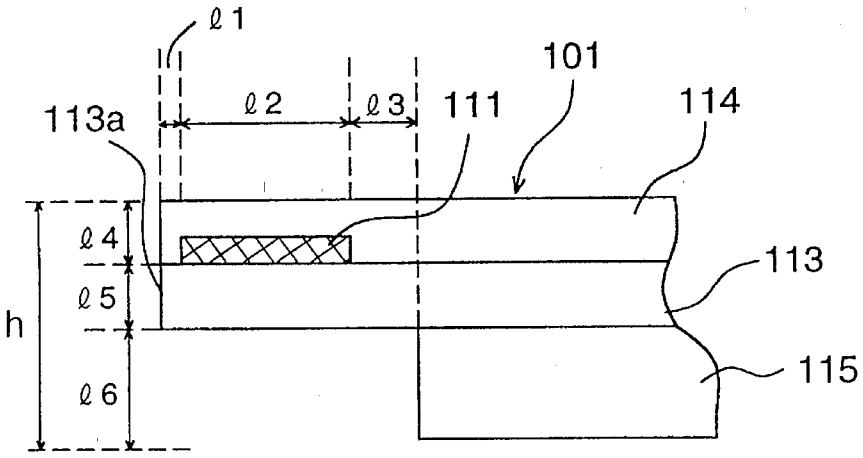

As illustrated in FIGS. 16(*a*) and 16(*b*), the length $l_2$ of the electrode section 111 formed of a conductive ink layer in the sleeve rotating direction is preferably 0.01 to 1 mm, and more preferably 0.05 to 0.5 mm. In the case where the length $l_2$ is not more than 0.01 mm, toner particles are not sufficiently oscillated, so that the developing properties are lowered, and it is difficult to dispose the entire electrode section only downstream of the closest position between the insulating base plate 113 and the developing sleeve. It is constructed that the length $l_2$ of the electrode section 111 in the longitudinal direction is larger than the length of the developer conveyance region on the developing sleeve. A terminal for supplying an impressing voltage may be formed outside of the developer conveyance region. Due to the foregoing, the generation of a redundant toner cloud is prevented, and the apparatus can be kept clean, so that color mixture can be prevented.

As illustrated in FIGS. 16(*a*) and 16(*b*), a setting position of the electrode section 111 on the downstream side is preferably set at a position which is located in the upstream of the end portion of the base plate, wherein the distance $l_1$ is set to be preferably 0 to 0.5 mm, and more preferably 0.05 to 0.2 mm. In the case where this $l_1$ is not more than 0, current leakage tends to occur. In the case where $l_1$ is not less than 0.5 mm, a toner scattering space is blocked, and the developing properties are deteriorated.

In order to reinforce the control electrode assembly and also to ensure the toner scattering space, a reinforcing member 115 may be attached onto the lower or upper layer of the base plate 113. As illustrated in FIG. 16(*a*), the reinforcing member 115 is provided on the lower layer side of the base plate 113. It is preferable that an end portion of the reinforcing member 115 is disposed on the upstream side of an end portion of the electrode section 111 on the upstream side, wherein the distance between both end portions is $l_3$=0 to 1 mm, and preferably 0 to 0.5 mm. When $l_3$ is not more than 0, the developing properties are deteriorated. When $l_3$ is not less than 1 mm, the oscillation of the electrode section caused by the alternating electric field can not be prevented. FIG. 16(*a*) shows an example in which the reinforcing member 115 is provided, and FIG. 16(*b*) shows an example in which the reinforcing member 115 is not provided.

As shown in FIGS. 16(*a*) and 16(*b*), the entire thickness h of the control electrode assembly 101 is preferably 0.1 to 1 mm, and more preferably 0.2 to 0.5 mm. In general, when the thickness is not more than 0.1 mm, the reinforcing member has poor mechanical strength. When the thickness is not less than 1 mm, it is difficult to insert the electrode section into a developing gap.

Material to be used for the insulating base-plate may be arbitrarily selected from the aforesaid various insulating materials and inorganic materials.

In general, the conductive ink is composed of conductive filler, resin binder, solvent, and additive (hardening agent, if necessary). In the present invention, various conductive ink may be applied to the electrode section, for example, conductive ink of the prior art may be applied. The conductive ink is preferably dried and hardened at a room temperature. In the case where a heat-resistant base plate such as a ceramic base plate is used, conductive ink which is burnt at high temperature may be used. Examples of preferable ink which can be dried at a room temperature are as follows.

Examples of conductive fillers are: metals such as silver, gold, platinum palladium, copper, nickel, and tungsten; metallic oxides such as ruthenium oxide and copper oxide; particles of copper, graphite, nickel and glass coated with silver; amorphous carbon powder; graphite; and carbon fibers.

Examples of usable binders are resins such as epoxy type, polyamide type, phenol type, acrylic type, polyester type, alkyd type, urethane type, silicon type, and rubber type. Acrylic resin is preferably used.

In general, a solvent must have high evaporation and dissolution properties. Examples of usable solvents are: aliphatic hydrocarbon such as n-hexane and n-heptane; aromatic hydrocarbon such as cyclohexane and toluene; alcohol such as methyl alcohol and ethylene alcohol; ester such as methyl acetate and ethyl acetate; ketone such as acetone and methylethyl ketone; glycol such as ethylene glycol and propylene glycol; glycolether such as ethyleneglycolmonomethylether and ethyleneglycolmonoethylether; and glycoletherester such as ethyleneglycolmonoethylacetate and ethyleneglycolmonobutylacetate.

Conductive ink baked at high temperature must contain at least two types of binders, one is a primary binder to provide necessary viscosity and tack, the other is a secondary binder to adhere a printing film onto a base plate. Examples of usable primary binders are cellulose derivative and acrylic resin, and examples of usable secondary binders are lead borosilicate type compounds.

For the purpose of ensuring electric insulating properties, preventing corrosion, protecting the surface and increasing the mechanical strength of the entire control electrode, the surface of the conductive ink layer or the surface of the entire electrode section may be coated with the insulating resin layer 14 (shown in FIGS. 16(*a*) and 16(*b*)).

Insulating materials of the prior art may be used for the insulating layer 114. The thickness $l_4$ may be 0.005 to 0.5 mm, but is preferably 0.01 to 0.5 mm, and more preferably 0.02 to 0.3 mm (shown in FIGS. 16(*a*) and 16(*b*)).

In the present invention, the electrode section may be made of conductive ink in the following manner.

A conductive ink layer is printed in a predetermined portion on an insulating film so that the electrode section can be formed. In this case, when the ink which can be dried at a room temperature is used, a printing method such as letter press, mimeograph, intaglio and lithography is preferably employed. When the ink which can be baked at high temperature is used, a printing method such as mimeograph is preferably employed, and more preferably a screen printing method is employed. In this case, examples of usable screens are: a metallic mask formed of a metallic sheet, and a mesh made of resin fabrics or metallic wires. Examples of usable squeegees are polyurethane, neoprene and silicon. Length of the electrode section formed of conductive ink in the sleeve rotating direction is preferably 0.01 to 1 mm, and more preferably 0.05 to 0.5 mm.

It is constructed that the length of the electrode section in the longitudinal direction is larger than that of the developer conveyance region. A terminal portion for impressing a voltage may be formed in a region outside the developer conveyance region.

A setting position of the electrode section 111 on the downstream side is preferably set at a position which is located in the upstream of the end portion of the base plate, wherein the distance is set to be preferably 0 to 0.5 mm, and more preferably 0.05 to 0.2 mm.

In order to dry conductive ink coated on the base plate, the following methods can be employed: In the case where the conductive ink which can be dried at a room temperature is used, the ink layer is allowed to stand for 5 to 15 minutes at the room temperature, and then the ink is dried by infrared rays in an electric furnace at temperatures of 100° to 150° C. for 20 minutes. In the case where the conductive ink which can be baked at high temperature is used, the ink layer is baked at temperatures of 750° to 1000° C. for 1 hour in a belt type furnace. In this case, a base plate made of heat-resistant material such as glass and ceramics is utilized.

When the insulating layer 114 is formed, the following methods may be employed: insulating resin dissolved in a solvent is coated; an insulating film made of polyethylene terephthalate or polycarbonate is adhered; and insulating ink is coated.

A reinforcing plate may be attached to the apparatus of this invention. In order to strengthening the control electrode or to ensure a toner scattering space, the reinforcing plate 115 may be attached onto the lower or upper layer of the base plate. In this case, the same material as that of other insulating material may be used. A case in which the reinforcing member is not used is shown in FIG. 14(*a*), and a case in which the reinforcing member is used is shown in FIG. 14(*b*).

In the present invention, as illustrated in FIG. 16(*a*), the reinforcing member 115 is provided on the lower layer side of the base plate 113. It is preferable that an end portion of the reinforcing member 115 is disposed on the upstream side of an end portion of the electrode section 111 on the upstream side, wherein the distance between both end portions is $l_3$=0 to 1 mm. When $l_3$ is not more than 0, the developing properties are deteriorated. When $l_3$ is not less than 1 mm, the effect of reinforcement is small, and the oscillation of the electrode section 111 caused by the alternating electric field can not be prevented. The thickness $l_5$ of base plate 113 in FIGS. 16(*a*) and 16(b) may be 0.01 to 1 mm. The thickness $l_6$ is preferably 0.03 to 0.7 mm, and more preferably 0.05 to 0.5 mm (Refer to FIG. 28.).

The developing method used for the present invention is the same as that described before.

Figure 17:
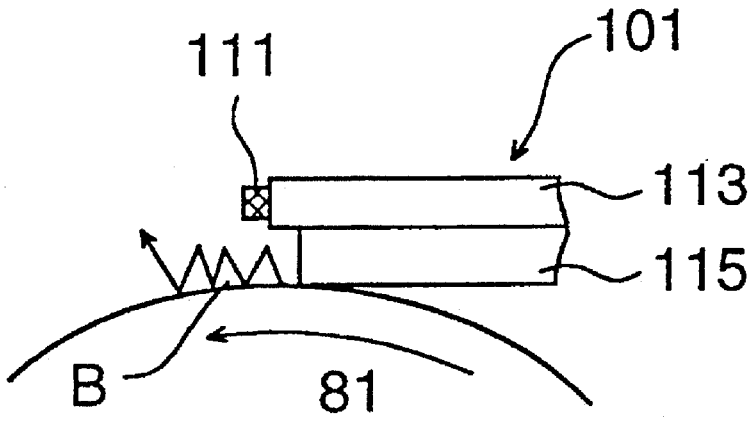
FIG. 17 is a schematic illustration showing further another structure of the electrode member of the present invention.
Figure 18:
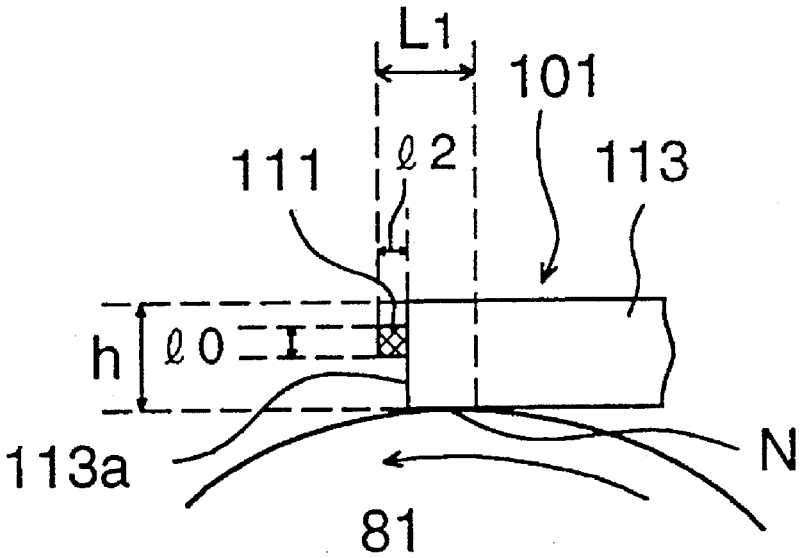
FIG. 18 is another schematic illustration showing the construction of the apparatus of FIG. 17.

Next, an electrode assembly will be explained which is related to the invention in which an electrode is formed when a conductive member is fixed. The electrode member of the present invention is illustrated in FIGS. 17 and 18, and also shown in FIGS. 19 and 20. The control electrode assembly for developing apparatus use provided with an electrode section 111 includes: a base plate 113 made of insulating material, a portion of the base plate 113 being located close to the developing sleeve 81 or coming into contact with the developing sleeve 81 upstream of the developing region of the developing sleeve 81 opposed to the image forming body; and an electrode section 111 formed on the base plate 113, the entire electrode section being disposed downstream of the closest position N where the base plate 113 and the developing sleeve 81 are located most closely, with respect to the developer conveyance direction, wherein the electrode section 111 is formed when a conductive member is fixed to a fore end portion of the base plate 113 made of insulating material.

As a result of the foregoing, the electrode section 111 does not exist upstream of the developing region, so that the formation of an alternating electric field can be avoided upstream of the developing region. In this case, for example, the developing region is a region designated by character A illustrated in FIGS. 26(*a*) and 26(*b*) showing the construction of the developing apparatus. Therefore, a problem in which an amount of developer conveyed to the developing region is lowered can be avoided, so that a clear image can be formed with a sufficient amount of developer.

It is not necessarily easy to dispose the entire electrode member 111 downstream of the developer conveyance direction with respect to the closest position N between the base plate 113 and the developing sleeve 81 as described above. However, according to the present invention, when the electrode section 111 is formed of a fixed conductive member, the entire electrode member 111 can be easily disposed downstream of the closest position N and satisfactory effects can be provided.

In the present invention, concerning the material of the insulating base plate 113, the relative dielectric constant of the insulating base plate 113 is preferably 1.5 to 5 at the frequency of 1 MHz. In the case where the relative dielectric constant is not more than 1.5, the alternating electric field is not sufficiently high in the fore end portion of the control electrode, so that sufficient developing properties can not be provided. On the contrary, in the case where the relative dielectric constant is not less than 5, the intensity of the alternating electric field is increased too high, and the image quality tends to be deteriorated.

Length $l_2$ (shown in FIG. 18) of the conductive member of the electrode section 111 in the rotational direction of the developing sleeve is preferably 0.01 to 1 mm, and more preferably 0.05 to 0.5 min. In the case where the length $l_2$ is not more than 0.01 mm, the developing properties tend to be lowered due to insufficient toner oscillation. In the case where the length $l_2$ is not less than 1 mm, the toner particles are oscillated too intensely resulting in overcharge, and the developing properties are deteriorated. Further, it becomes difficult to dispose the electrode section 111 only downstream of the closest position N between the insulating base plate and the developing sleeve, which is the characteristic construction of the present invention. Length $L_1$ between the closest position N and the fore end on the downstream side of the control electrode member is preferably 0.02 to 5 mm.

Figure 19:
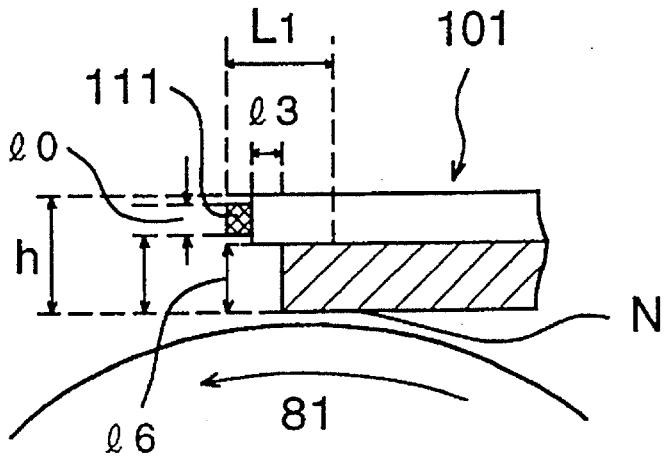
FIG. 19 is another schematic illustration showing the construction of the apparatus of FIG. 17.
Figure 20:
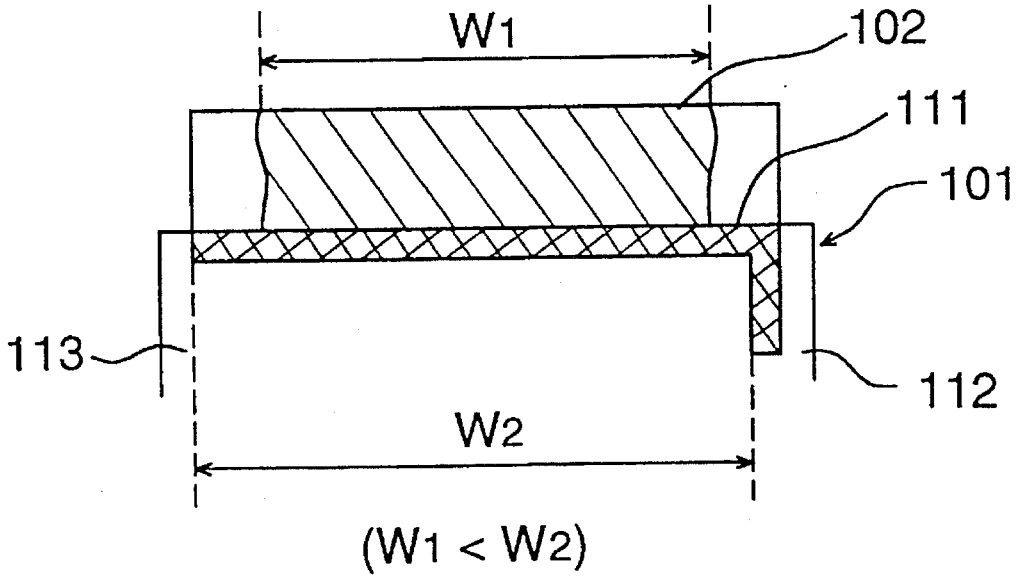
FIG. 20 is another schematic illustration showing the construction of the apparatus of FIG. 17.

As illustrated in FIGS. 18 and 19, the length $l_0$ of the electrode section 111 in the radial direction of the image forming body is preferably 0.01 to 1 mm, and more preferably 0.05 to 0.5 mm. In the case where this length $l_0$ is not more than 0.01 mm, there is a possibility that sufficient strength of adhesion can not be provided. In the case where the length $l_0$ is not less than 1 mm, it becomes difficult dispose the electrode section in a development gap, and further the electrode tends to come into contact with the sleeve or image retainer so that discharging takes place.

It is constructed that the length $l_2$ of the electrode section 111 in the longitudinal direction is larger than the length of the developer conveyance region on the developing sleeve. A terminal for supplying an impressing voltage may be formed outside of the developer conveyance region. Due to the foregoing, the generation of a redundant toner cloud is prevented, and the apparatus can be kept clean, so that color mixture can be prevented (shown in FIG. 20).

It is preferable that the conductive member composing the conductive section 111 is disposed at the fore end portion of the base plate 113 on the downstream side in the circumferential direction.

In order to reinforce the control electrode and also to ensure the toner scattering space, a reinforcing member 115 may be attached onto the lower or upper layer of the base plate 113. As illustrated in FIG. 19, the reinforcing member 115 is provided on the lower layer side of the base plate 113. It is preferable that an end portion of the reinforcing member 115 is disposed on the upstream side of an end portion of the electrode section 111 on the upstream side, wherein the distance between both end portions is $l_3$=0 to 1 mm, and preferably 0 to 0.5 mm. When $l_3$ is not more than 0, the developing properties are deteriorated. When $l_3$ is not less than 1 mm, the oscillation of the electrode section caused by the alternating electric field can not be prevented.

As shown in FIGS. 18 and 19, the entire thickness h of the control electrode assembly 101 is preferably 0.1 to 1 mm, and more preferably 0.2 to 0.5 mm. In general, when the thickness is not more than 0.1 mm, the reinforcing member has poor mechanical strength. When the thickness is not less than 1 mm, it is difficult to insert the electrode section into a developing gap.

Material to be used for the insulating base plate may be arbitrarily selected from the aforesaid various insulating materials and inorganic materials.

Various conductive materials may be used for the conductive member composing the electrode section of the present invention. For example, conductive materials of the prior art can be applied to the electrode section of the present invention.

Examples of usable conductive materials are copper and copper alloys such as oxygen free copper, brass (copper-zinc), copper-cadmium, silicon copper (copper-tin), phosphor bronze, copper-beryllium, and Corson alloy (copper-nickel-silicon). Further, examples of usable conductive materials are: aluminum alloys such as aluminum-silicon-magnesium (Aldrey); metals such as titanium, tantalum, tungsten, nickel, and molybdenum; and their alloys.

For the purpose of ensuring electric insulating properties, preventing corrosion, protecting the surface and increasing the mechanical strength of the entire control electrode, the surface of the conductive member may be coated with the insulating resin layer. Various insulating materials of the prior art may be used for the coating material.

In the present invention, the electrode section 111 may be composed of the conductive material in the following manner.

A conductive member is adhered onto the fore end portion of the base plate of an insulating film. In this case, an adhesive agent may be applied to adhere the conductive member onto the fore end portion of the base plate. Alternatively, the base plate and the conductive member may be fused with pressure at high temperature without using an adhesive agent. Either method may be employed. From the viewpoints of material selection, easiness of manufacture, accuracy of an electrode setting position, electric insulation, and improvement in mechanical strength, adhesive agents are preferably used.

Adhesive agents of the prior art by which metal and resin can be adhered are used for the present invention. Examples of usable adhesive agents are: a contact type adhesive agent in which chloroprene rubber or nitrile rubber is dissolved in a solvent, vinylacetate resin paste, expoxy resin adhesive agent, polyurethane adhesive agent, phenol resin adhesive agent, α-cyanoacrylate type adhesive agent, and hot-melt type adhesive agent mainly containing one of ethyleneaceticacidvinyl copolymer type resin, polyamide, polyester, and polyurethane.

These adhesive agents are applied onto one of the adhesive surfaces of the conductor member and the base plate film, or both the adhesive surfaces by means of brushing, spraying, doctor-blade, and roller coating. In this way, adhesion is performed.

Figure 21:
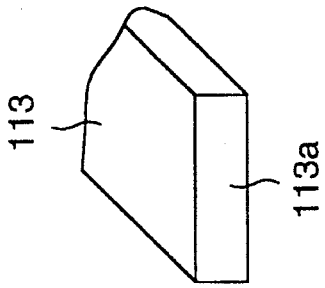
FIGS. 21(*a*) to 21(*e*) are other schematic illustrations showing the construction of the apparatus of FIG. 17, wherein FIGS. 21(*a*) to 21(*c*) are views for explaining forming processes.
Figure 21:
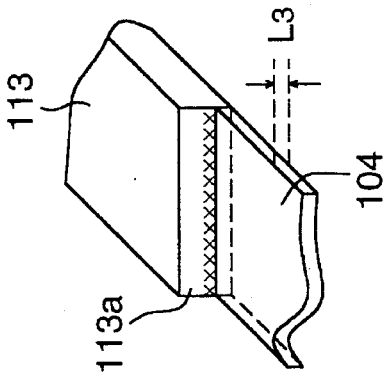
Figure 21:
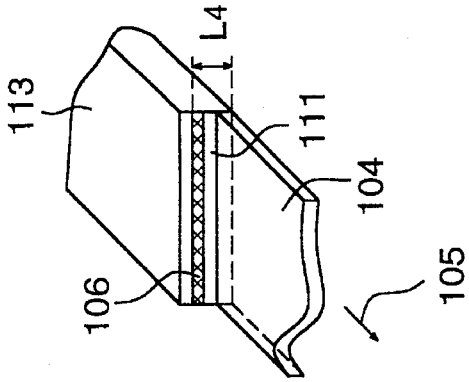
Figure 21:
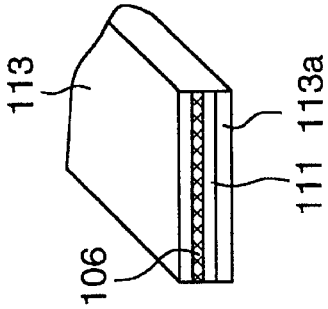
Figure 21:
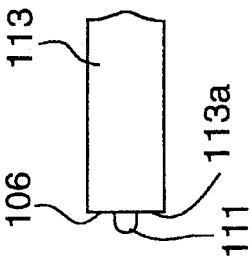

In order to maintain the accuracy, adhesion is performed by the method illustrated in FIGS. 21(*a*) to 21(*e*). The method will be described as follows. As illustrated in FIGS. 21(*a*), an insulating base plate 113 is prepared. As illustrated in FIG. 21(*b*), a jig 104 (for example, the thickness L3=150 μm) is set at a fore end 113*a* of the base plate 113. A conductive member 111 is provided in a portion designated by marks X in FIG. 21(*b*). Next, as illustrated in FIG. 21(*c*), an adhesive agent 106 is applied onto the surface designated by $L_4$=300 μm, and the conductive member 111 such as a wire is adhered. Then, as illustrated in FIG. 21(*c*), the jig 104 is dismounted in a direction shown by an arrow 105. In this way, as illustrated in FIG. 21(*d*), an electrode can be provided in which the conductive member 111 is fixed at the fore end 113*a* of the base plate 113 with the adhesive agent 106. The side structure of the electrode is shown in FIG. 21(*e*).

Figure 22:
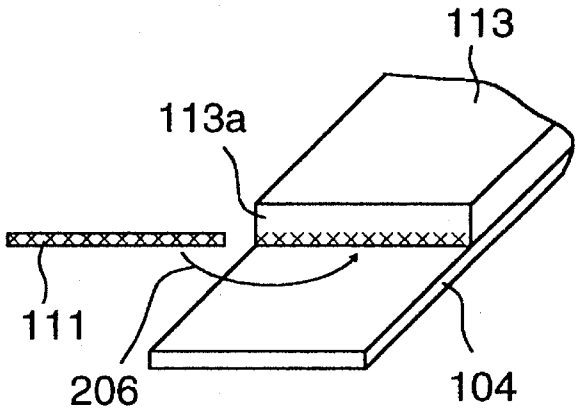
FIGS. 22(*a*) to 22(*c*) are other schematic illustrations showing the construction of the apparatus of FIG. 17, wherein 22(*a*) to 22(*c*) are views for explaining forming processes.
Figure 22:
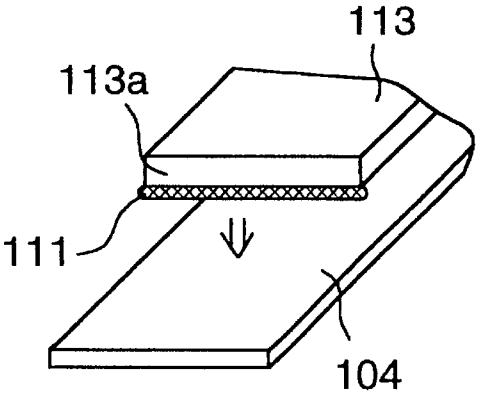
Figure 22:
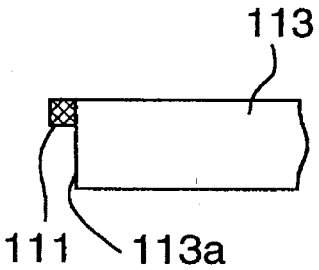

Alternatively, an electrode structure can be provided as follows. As illustrated in FIG. 22(*a*), the insulating base plate 113 is put on the jig 104. Then an adhesive agent is coated on a portion designated by the marks X shown in FIG. 22(*a*), and the conductive member 111 is adhered as shown by an arrow 206. After that, the jig 104 is disconnected as illustrated in FIG. 22(*b*), and an electrode structure can be provided as shown in a side view of FIG. 22(*c*) in which the conductive member 111 is fixed at a fore end portion of the base plate 113.

It is possible to attach a reinforcing plate to the electrode structure of this invention. In order to strengthen the control electrode and to ensure a toner scattering space, a reinforcing member may be provided on a lower or an upper layer of the base plate film. Material to be used for the reinforcing member may be the same as that of other insulating members. (Refer to FIGS. 17, 19 and 23.)

In the present invention, from the viewpoints of improving the developing properties and ensuring the toner scattering space, the reinforcing member is provided on the lower layer side of the base plate. It is preferable that an end portion of the reinforcing member is disposed on the upstream side of an end portion of the electrode assembly on the upstream side, wherein the distance between both end portions is 0 to 1 mm. When the distance is not more than 0, the developing properties may be deteriorated. When the distance is not less than 1 mm, the effect of reinforcement is small, and the oscillation of the electrode assembly caused by the alternating electric field can not be prevented.

Thickness of the reinforcing plate is preferably 0.03 to 0.7 mm, and more preferably 0.05 to 0.5 mm.

Figure 23:
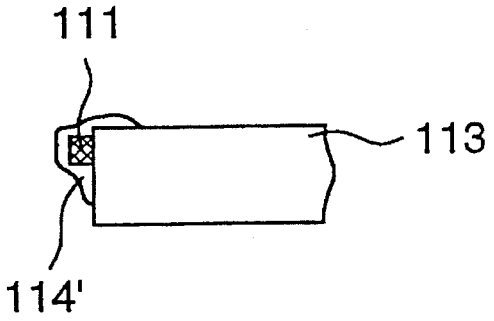
FIGS. 23(*a*) and 23(*b*) are other schematic illustrations showing the construction of the apparatus of FIG. 17.
Figure 23:
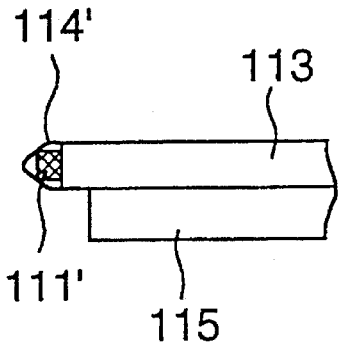

In the present invention, it is preferable that the conductive member 111 is coated with an insulating layer as illustrated in FIGS. 23(*a*) and 23(*b*) before the conductive member is adhered onto the base plate film. In this case, the insulating layer is designated by numeral 114'. In this connection, FIG. 23(*a*) shows a case in which the reinforcing member is not provided, and FIG. 23(*b*) shows a case in which the reinforcing member 115 is provided.

When the insulating layer is formed, the following methods may be employed: insulating resin dissolved in a solvent is coated; and an insulating film made of polyethylene terephthalate or polycarbonate is adhered.

In the case where an insulating film is used, after the conductive member is adhered onto the base plate, the insulating film may be adhered all over the electrode section (shown in FIGS. 23(*a*) and 23(*b*)).

The same developing method as that of the example described before may be applied to this example.

EXAMPLE

An example of the present invention will be explained as follows.

Example 1

Figure 24:
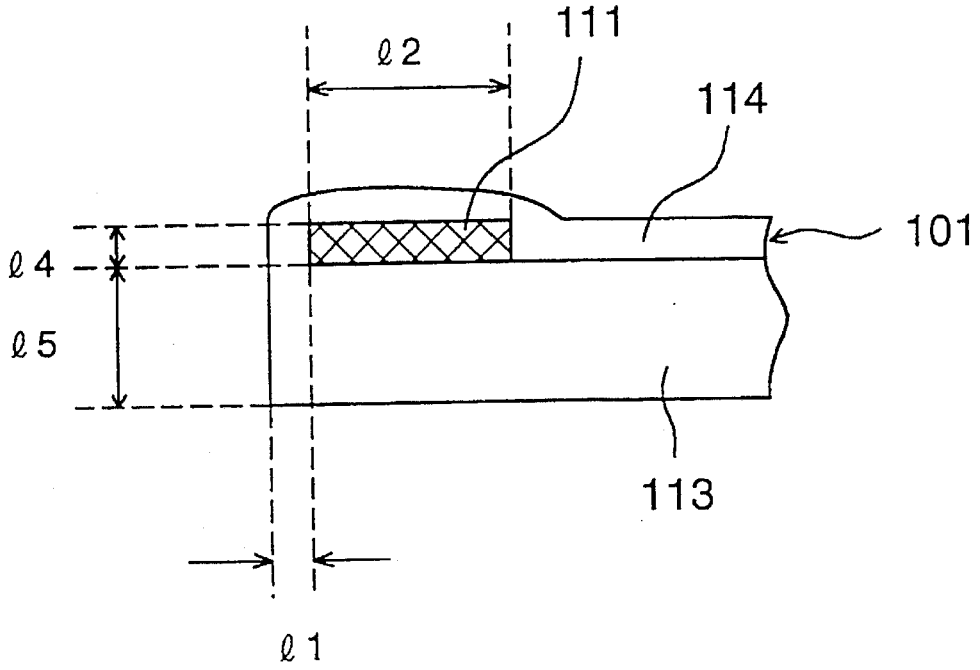
FIG. 24 is an arrangement view showing Example 1 in which the formation of a control electrode is shown.
Figure 25:
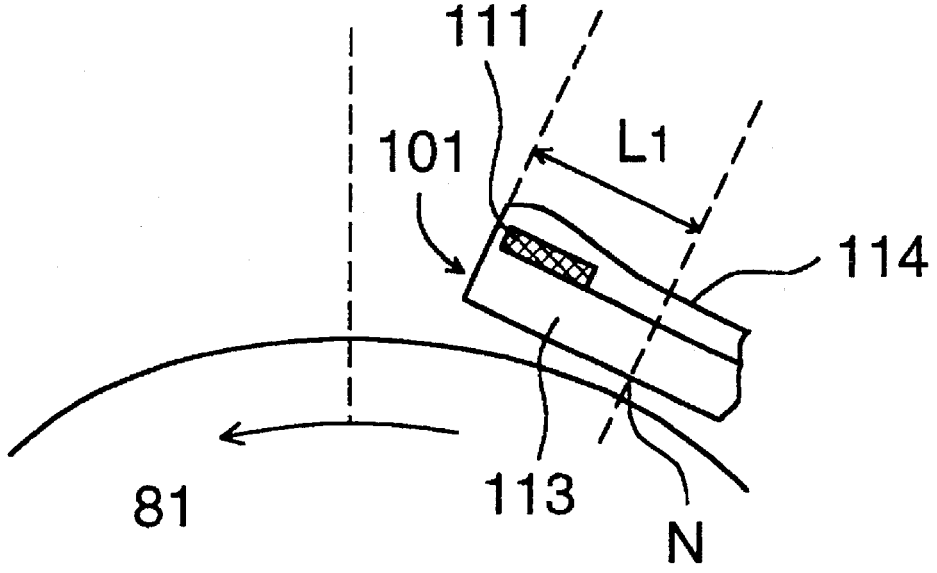
FIG. 25 is another arrangement view showing Example 1 in which the formation of a control electrode is shown.
Figure 26:
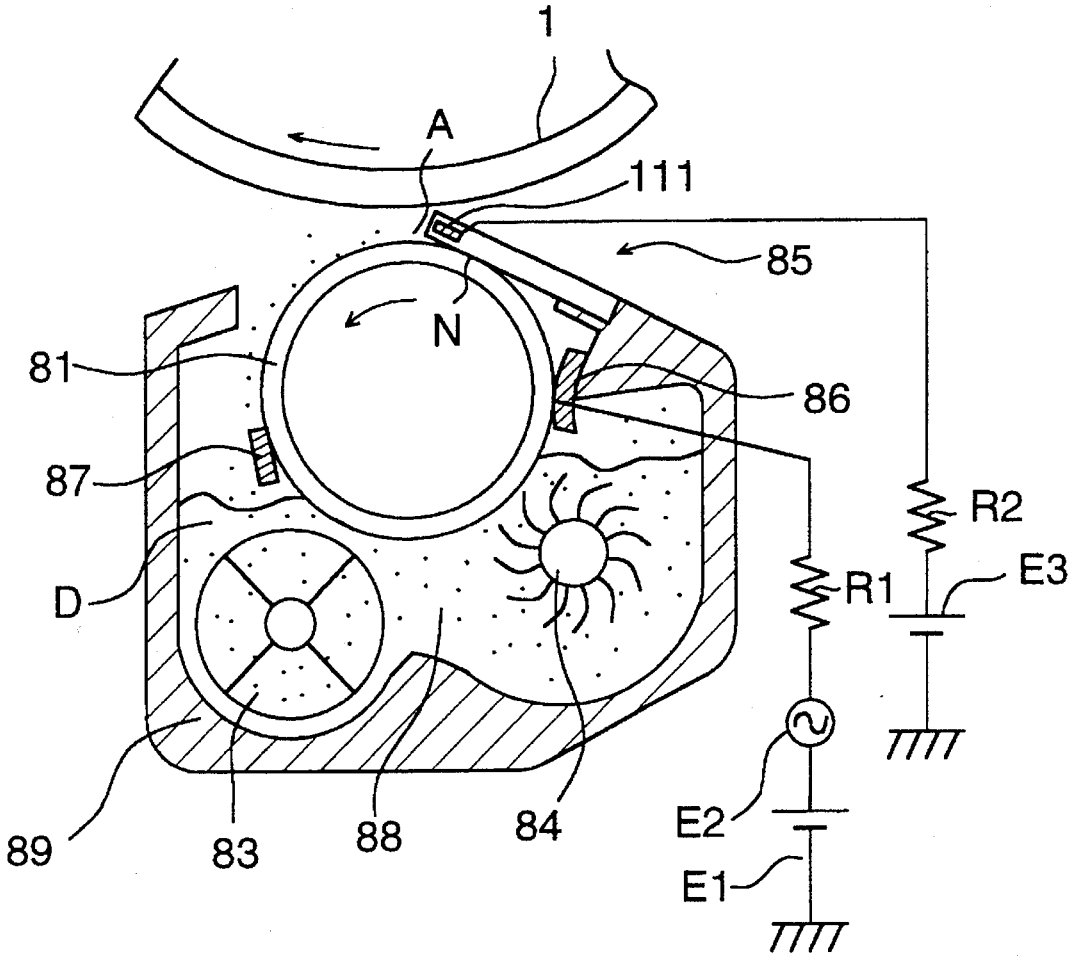
FIGS. 26(*a*) and 26(*b*) are other arrangement views showing Example 1 in which the formation of a control electrode is shown.
Figure 26:
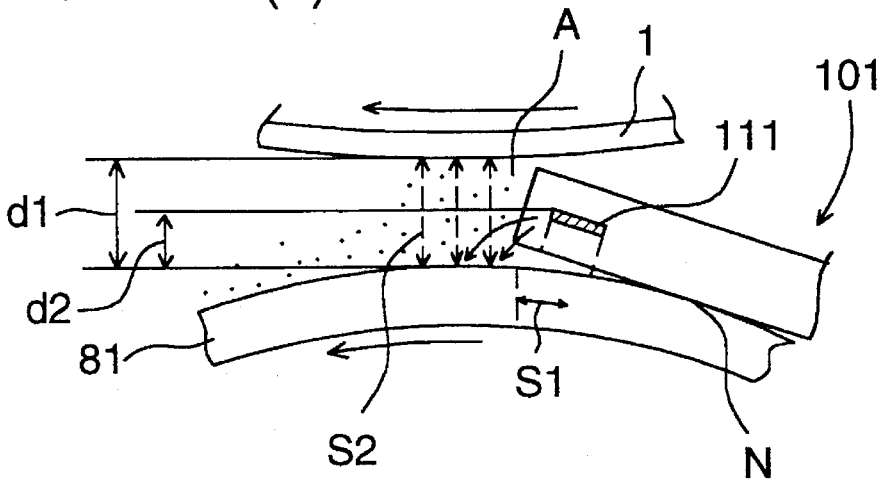

In this example, a piece-of metallic foil, especially a piece of copper foil is used for forming an electrode section of the control electrode assembly. With reference to FIGS. 24 to 26(*b*), this example will be explained as follows.

In this example, as illustrated in FIG. 24, the base plate 113 was formed of an insulating plate made of glass epoxy, and the electrode section 111 was formed of a piece of copper foil, the thickness of which was 0.03 mm, and the photo-registration method was applied to construct the electrode section. An image formation side of the electrode section was covered with a Maylar tape of 0.1 mm thickness. This Maylar tape functioned as the insulating layer (shown in FIGS. 24 and 25). In FIG. 24, exemplary dimensions may be as follows: $l_1$=0.1 mm; $l_2$=0.3 mm; and $l_5$=0.15 mm.

In this example, the base plate 113 is composed of an insulating material member, a portion of which is located close to a developing sleeve opposed to an image forming body, or a portion of which comes into contact with the developing sleeve, in the upstream of the developing region. The electrode section 111 formed of metallic foil (copper foil) is formed on the base plate 113. The entire electrode section 111 is disposed on a downstream side of the developer conveyance direction with respect to the closest position N between the base plate 113 and the developing sleeve. In this connection, in FIG. 25, the closest position N is separated from the sleeve 81, however, the base plate 113 may be contacted with the developing sleeve 81, and the contact point can be the closest position N.

A developing apparatus illustrated in FIGS. 26(*a*) and 26(*b*) were applied to this example, and the aforesaid electrode member was assembled to the developing apparatus, and developing operations were conducted. As a result, a sufficient amount of developer was supplied, and images of high quality were provided.

Sectional views of the aforesaid developing apparatus are shown in FIGS. 26(*a*) and 26(*b*). FIG. 26(*a*) is a sectional view. In the drawing, numeral 81 is a developing sleeve made of nonmagnetic material such as aluminum and stainless steel, which is a developer conveyance body rotatably supported. In this case, the surface of the developing sleeve 81 is subjected to sand blasting so that the surface roughness is 1 to 2 μm according to the surface roughness evaluation method prescribed by JIS-B0610. Numeral 83 is a stirring unit for stirring the developer D so that the composition can be made uniform. Numeral 84 is a fur brush for supplying the developer D to the developing sleeve 81. Numeral 86 is a regulating blade made of rubber for regulating the thickness of a developer layer formed on the developing sleeve 81. Numeral 85 is a control electrode assembly provided on an upstream side of the developing region A for the purpose of forming an oscillating electric field. The electrode assembly 85 is formed in the manner described before (shown in FIGS. 24 and 25). A toner cloud is generated between the electrode section 111 of the control electrode assembly 85 and the developing sleeve 81. A layer of the developer D, the thickness of which is regulated by the regulating blade 86, is moved by the rotation of the developing sleeve 81 and conveyed to the developing region A. In order to keep the developer layer on the developing sleeve 81 separate from the surface of the image retainer belt 1 so as to form a gap, a gap formed between the developing sleeve 81 and the control electrode assembly 85 is appropriately adjusted, and also a gap formed between the developing sleeve 81 and the image retainer belt 1 is adjusted. Numeral 87 is a cleaning blade for removing developer from the surface of the developing sleeve 81 after the developer has passed through the developing region A. Numeral 88 is a developer reservoir, and numeral 89 is a casing.

The developing sleeve 81 is impressed through a protective resistor R1 with a bias voltage in which DC and AC voltage components are superimposed. In this case, the DC voltage component is supplied from a DC bias power source El, and the AC voltage component is supplied from an AC bias power source E2. An electrode 111 of the electrode assembly 85 is impressed with a DC bias voltage supplied from a DC bias power source E3 through a protective resistor R2.

In this example, the first oscillating electric field S1 is generated between the electrode 111 and the developing sleeve 81, wherein the electrode 111 is provided on an electrode member 101 of the electrode assembly 85 which comes into contact with the developer layer on the developing sleeve 81 at the point N. In a conventional developing apparatus, the second oscillating electric field S2 is generated between the image retainer belt 1 and the developing sleeve 81. As compared with the second oscillating electric field S2, the intensity of the first oscillating electric field S1 is allowed to be higher than that of the second oscillating electric field S2, and at the same time an electric field is generated between the image retainer belt 1 and the developing sleeve 81 for the purpose of conveying toner particles from the developing sleeve 81 to the image retainer belt 1.

FIG. 26(*b*) is an enlarged sectional view showing the developing region A and its vicinity. As can be seen from FIG. 26(*b*), the entire electrode section 111 composed of metallic foil (copper foil) is disposed on a downstream side of the closest position N between the base plate 113 and the developing sleeve 81. As illustrated in FIGS. 26(*a*), the developing sleeve 81 is impressed with a bias voltage in which DC and AC voltage components are superimposed, and the electrode section 111 is impressed with a DC bias voltage. In this color image developing apparatus, a negatively charged OPC image retainer is used for the image retainer belt 1, and reversal development is performed. For example, when the image retainer is charged to be −800 V, the electrode section 111 is impressed with a bias voltage of −(1 to 1500) V, and preferably the absolute value of the bias voltage is (800 to 1000) which is larger than the image retainer voltage, and the developing sleeve 81 is impressed with a bias voltage of −700 V in which DC and AC components are superimposed. Frequency of the AC voltage component is 100 Hz to 20 KHz, and preferably 1 to 10 KHz, and the peak to peak voltage is 200 to 4000 V.

In the case where the electrode section 111 of the electrode assembly 85 is impressed with a voltage, the absolute value of which is larger than that of the developing sleeve 81, toner particles are not deposited on the electrode member 85, and a toner image on the image retainer belt 1 is not deposited on the electrode section 111 in the register process. Since the electrode section 111 is provided closer to the developing sleeve 81 than the image retainer belt 1, the intensity of the first oscillating electric field is higher than that of the second oscillating electric field.

It is preferable that a relation between $d_1$ and $d_2$ satisfies the following equation:

$$d_2=(0.2 \text{ to } 0.8)d_1$$

where $d_1$ is the closest distance between the image retainer belt 1 and the developing sleeve 81, and $d_2$ is the closest distance between the electrode section 111 and the developing sleeve 81. In this connection, $d_1$ is 0.2 to 1.0 mm. Since the electrode is arranged in a small developing region, it is preferable that an angle θ is 5° to 45°, wherein θ is defined as an angle formed between an opposing position of the developing sleeve 81 and the image retainer belt 1, and an end surface of the electrode section 111 as illustrated in FIG. 26(*b*). Also, the diameter of the developing sleeve 81 is preferably 10 to 60 mm.

Toner particles are oscillated by the action of the first oscillating electric field S1 in a direction perpendicular to the electric line of force. Therefore, the toner particles are scattered, and a toner cloud can be sufficiently generated. The second oscillating electric field S2 helps the toner cloud advance toward a latent image formed on the image retainer belt 1, so that uniform development can be accomplished.

In this case, the phase of the first oscillating electric field S1 and that of the second electric field S2 are the same. Accordingly, development is smoothly performed without causing a surge of toner oscillation. Since the phases are the same, the occurrence of dielectric breakdown caused by a change in phase can be avoided.

The wave form of the AC voltage component is not limited to a sine wave, but it may be a rectangular or a triangular wave. The higher the voltage of the AC component is, the more the toner particles are oscillated, although the oscillation depends on the frequency. On the other hand, dielectric breakdown such as fogging and lightning tends to occur. In this case, the occurrence of fog can be prevented by the DC voltage component, and the occurrence of dielectric breakdown can be prevented when the surface of the developing sleeve 81 is coated with a layer of resin or an oxide film, or when the surface of the developing sleeve 81 is coated with a semi-insulating layer.

Examples of usable resins to make toner particles are: styrene resin group, vinyl resin group, ethylene resin group, denatured rosin resin, acrylic resin group, polyamide resin, epoxy resin, polyester resin, and fatty acid wax of palmitic acid and stearic acid. Further, a color pigment and an electric charging control agent are added if necessary. In this way, the toner particles of this example were made by the same method as that of the conventional toner. The average particle size of toner particles is preferably not more than 20 μm, and more preferably not more than 10 μm, and most preferably 1 to 7 μm.

When necessary, a fluidity agent to improve the fluidity of particles and a cleaning agent to clean the surface of an image carrier are mixed with the aforesaid developer composed of nonmagnetic spherical toner particles. Examples of usable fluidity agents are: colloidal silica, silicon varnish, metallic soap and non-ion type surface active agent. Examples of usable cleaning agents are: fatty acid metallic salt, organic group substituted silicon, and fluorine.

In this example, nonmagnetic toner particles produced by the grinding granulation method were used which were composed of 100 weight parts of styrene acrylic resin (Highmer Up 110 produced by Sanyo Kasei Co.) and 10 weight parts of color pigment wherein the average particle size was 5 μm. Developing operation was performed by the developing apparatus shown in FIGS. 23(*a*) and 23(*b*). The average electric charging amount of toner was −5 μC/g.

Using the aforesaid color image forming apparatus, the developing operation was performed under the following conditions:

An OPC image retainer was applied to the image retainer belt 1, and its circumferential speed was 180 mm/sec. The maximum voltage of an electrostatic latent image formed on the image retainer belt 1 was −800 V. An outer diameter of the developing sleeve 81 was 30 mm, and its rotational speed was 150 rpm. A gap formed between the developing sleeve 81 and the image retainer belt 1 was 0.7 mm. A DC component of the bias voltage impressed upon the developing sleeve 81 was −700 V, and an AC component was 4 KHz, and a peak to peak voltage was 1000 V. The electrode section 85*a* of the control electrode was impressed with a DC voltage of −1000 V.

After the development had been performed under the above conditions, the formed toner image was transferred onto a transfer sheet of regular paper by means of corona discharge, and the transferred image was fixed by a heat-roller type fixing unit, the surface temperature of the heat roller of which was 140° C. Since the electrode assembly having an electrode section made of copper foil described in the present example was used in the development, an image of high quality was provided.

Example 2

Figure 27:
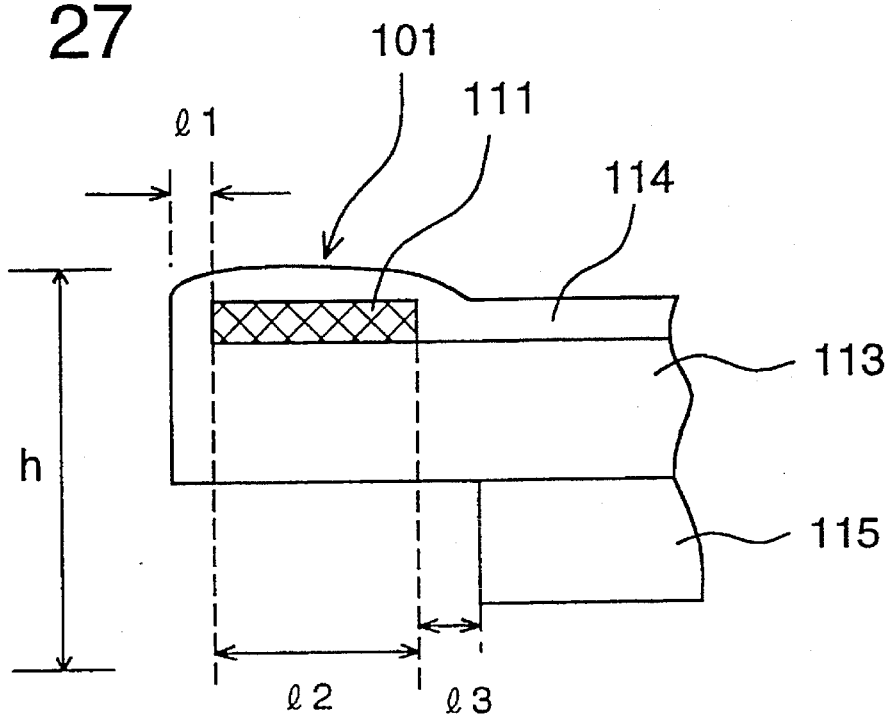
FIG. 27 is an arrangement view showing the formation of a control electrode member.

This example as seen in FIG. 27, is a variation of Example 1. In the same manner as that described in Example 1, a piece of copper foil was used for the metallic foil provided in the base plate 113. However, in this example, a reinforcing plate, which functioned as a reinforcing member 115, was attached onto the base plate 113 for reinforcement. In this example, the base plate 113 was made of polyimide, and the reinforcing member 115 was made of glass epoxy.

In the same manner as Example 1, the following conditions were adopted:

Thickness $l_4$ of copper foil composing the electrode section 111 was 0.03 mm. Distance $l_1$ between the fore end of the base plate 101 and the electrode section 111 was 0.1 mm. Width $l_2$ of the electrode section 111 was 0.3 mm. Thickness of the Maylar tape composing the insulating layer 114 was 0.1 mm. Length $L_1$ from the fore end of the base plate 113 to the closest position N was 1 mm. Further, the thickness of the reinforcing plate 115 was 0.015 mm, and the distance $l_3$ between the electrode section 111 and the reinforcing member 115 was 0.1 mm. The overall thickness dimension h was 0.21 mm.

Figure 28:
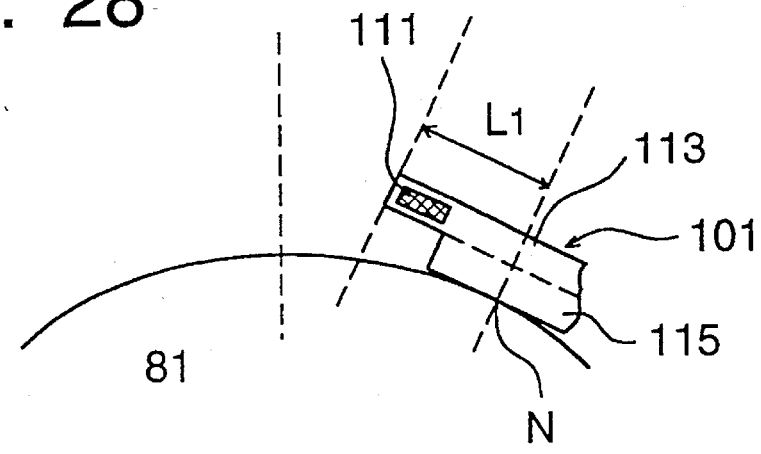
FIG. 28 is another arrangement view showing Example 2.

In the case shown in FIG. 28, the closest position N is the same as the contact point formed by the base plate 113 and the sleeve 81. However, as shown in FIG. 25, the base plate 113 may be separate from the sleeve 81. This situations are the same in the cases shown in FIGS. 30, 32, 34 and 36.

Example 3

Figure 29:
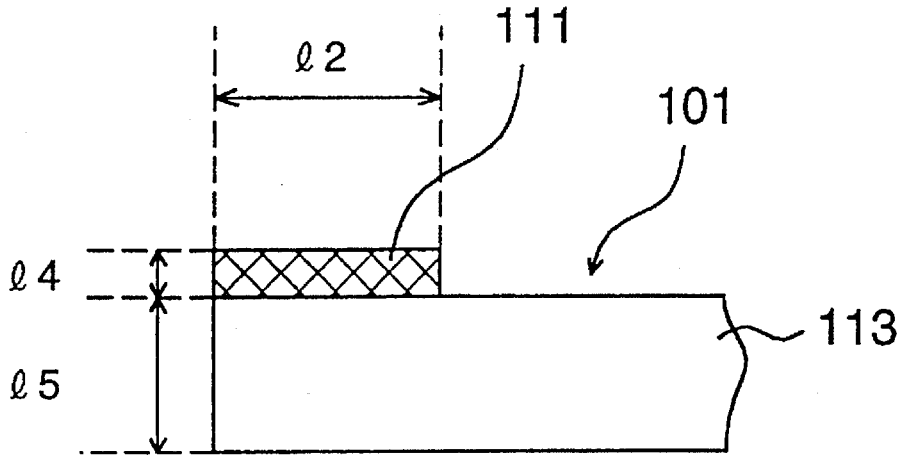
FIG. 29 is an arrangement view showing Example 3 in which the formation of a control electrode member is shown.
Figure 30:
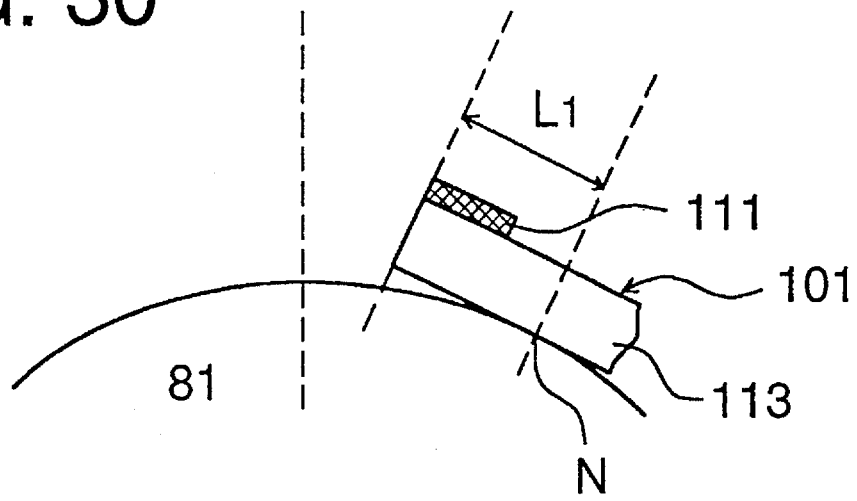
FIG. 30 is another arrangement view showing Example 3.

Example 3 is illustrated in FIGS. 29 and 30. Example 3 is one of the variations of Example 1. In the same manner as Example 1, a piece of copper (thickness $l_4$ was 0.03 mm, and width $l_2$ of the electrode was 0.5 mm) was provided on the base plate 113 so as to form the electrode section 111. However, in Example 1, the fore end of the base plate 113 on the upstream side was separated from the fore end of the electrode section 111, that is, $l_1$ was 0.1 mm. On the other hand, in this Example 3, the fore end of the base plate 113 coincides with the fore end of the electrode section 111.

In this example, the base plate 113 was made of glass epoxy, the thickness $l_5$ of which was 0.1 mm.

In the case shown in FIGS. 29 and 30, the insulating layer 114 was not provided, however, it may be provided in the same manner as Examples 1 and 2. Also, in the same manner as Example 2, the reinforcing member 115 may be provided.

As illustrated in FIG. 30, in this example, the distance $L_1$ between the fore end of the base plate (in this example, the fore end of the base plate coincides with the fore end of the electrode section 111) and the closest position between the base plate 113 and sleeve 81 was 1 mm.

Example 4

Figure 31:
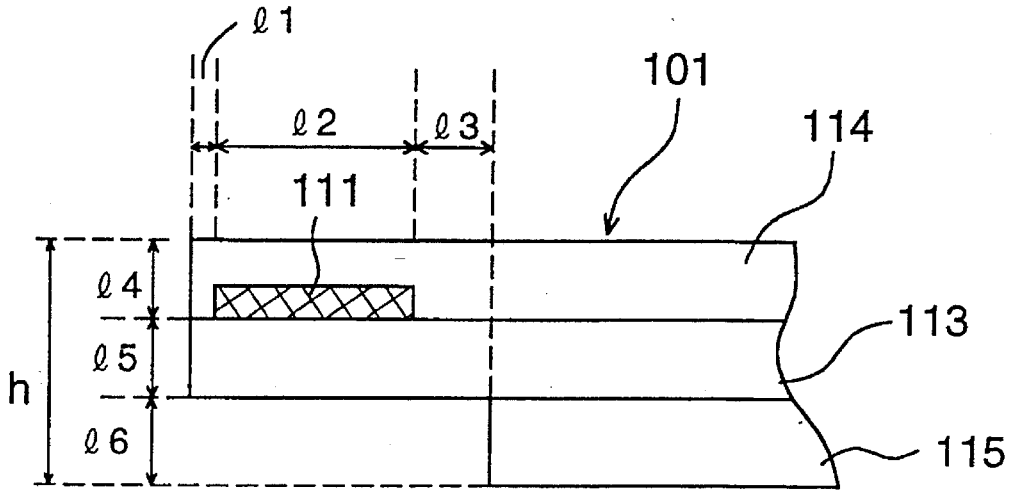
FIG. 31 is an arrangement view showing Example 4 in which the formation of a control electrode member is shown.
Figure 32:
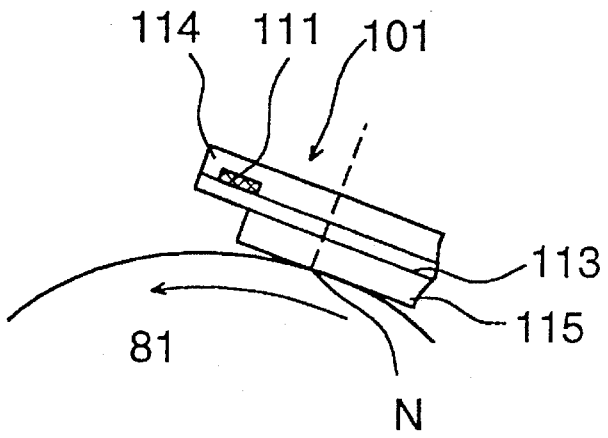
FIG. 32 is another arrangement view showing Example 4.

In this example, the control electrode was formed of a conductive ink layer. Example 4 will be described with reference to FIGS. 31 and 32.

Figure 33:
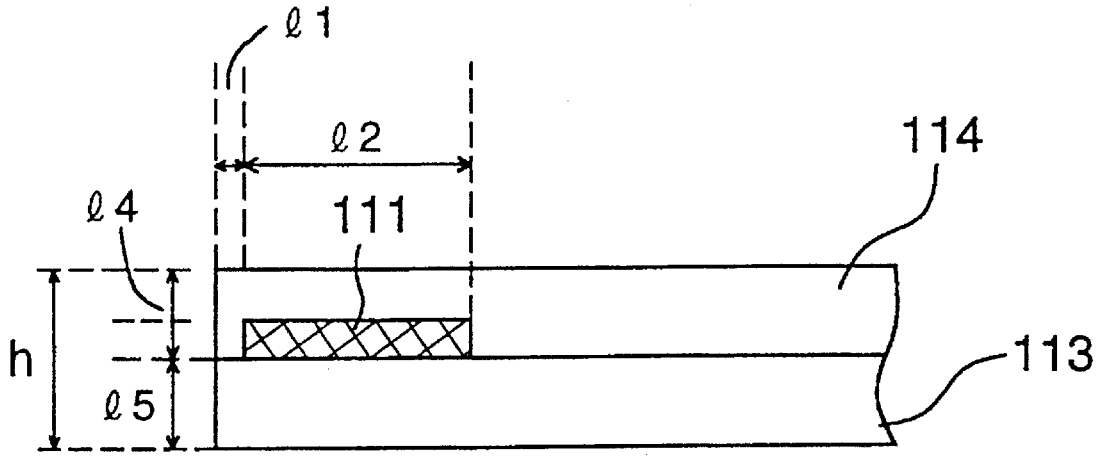
FIG. 33 is an arrangement view showing Example 5 in which the formation of a control electrode member is shown.
Figure 34:
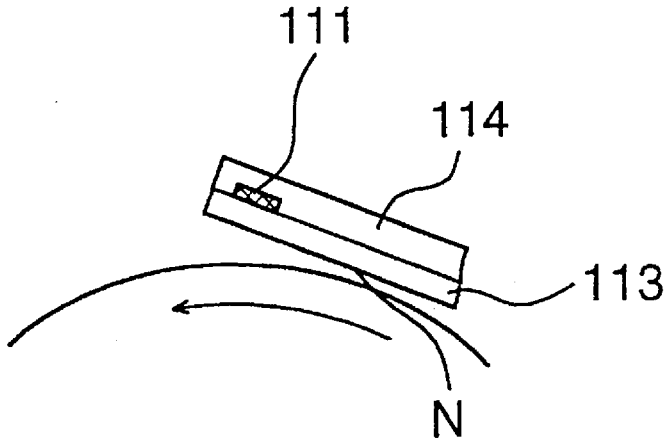
FIG. 34 is an arrangement view showing Example 5.

The following control electrode was assembled to the same developing apparatus as that of Example 1. That is, the control electrode was composed as follows:

The base film was made of polyimide. The conductive ink layer (the electrode section) was made of a room temperature drying type of conductive ink containing silver powder. The electrode section was formed on the base plate film by means of letterpress printing. The electrode section was coated with an insulating polyimide film. A reinforcing plate made of glass epoxy was attached onto the base plate film side. The control electrode was composed in this manner (shown in FIG. 33). This control electrode attached in the manner illustrated in FIG. 34, and developing was carried out. As a result, a sufficient amount of developer was conveyed, and images of high quality were formed.

In this example, the distance $l_1$ between the base plate 113 and the electrode section 111 was 0.05 mm. Width $l_2$ of the electrode section 111 was 0.2 mm. Thickness $l_4$ of the insulating layer 114 was 0.1 mm, but may be 0.05 mm. Further, the reinforcing member 115, the thickness $l_6$ of which was 0.1 mm, was provided. Distance $l_3$ between the electrode section 111 and the reinforcing member 115 was 0.1 mm. Thickness $l_5$ of base plate 113 was 0.1 mm. The entire thickness h including the reinforcing member 115 was 0.4 mm.

Example 5

In this example, the control electrode was formed of a conductive ink layer. Example 5 will be described with reference to FIGS. 33 and 34.

In this example, the base plate was made of glass. The conductive ink layer was made of a high temperature baking type of conductive ink containing silver powder. The electrode section was printed on the base plate by the screen printing method in which a metallic mesh was used. Then the electrode section 111 was formed being subjected to baking. The electrode was coated with an insulating polyimide film so as to form a control electrode (shown in FIG. 33). In the same manner as Example 2, this electrode was assembled to a developing apparatus and developing operation was carried out. As a result, a sufficient amount of developer was conveyed, and images of high quality were formed.

In this example, the distance $l_1$ between the base plate 101 and the electrode section 111 was 0.1 mm. Width $l_2$ of the electrode section 111 was 0.2 mm. Thickness $l_4$ of the insulating layer 114 was 0.1 mm. The thickness $l_5$ of base plate 113 was 0.3 mm. The entire thickness h was 0.45 mm, but may be 0.35 mm.

Example 6

Figure 35:
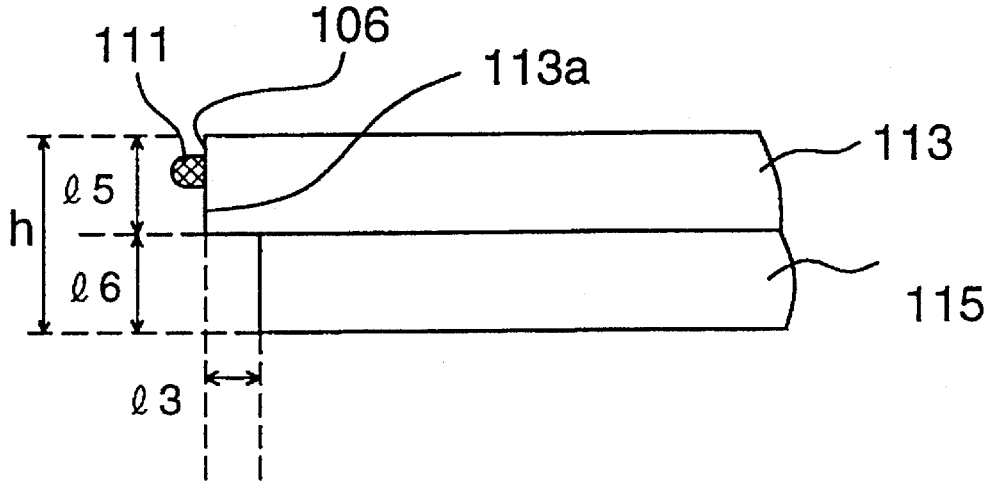
FIG. 35 is an arrangement view showing Example 6 in which the formation of a control electrode member is shown.
Figure 36:
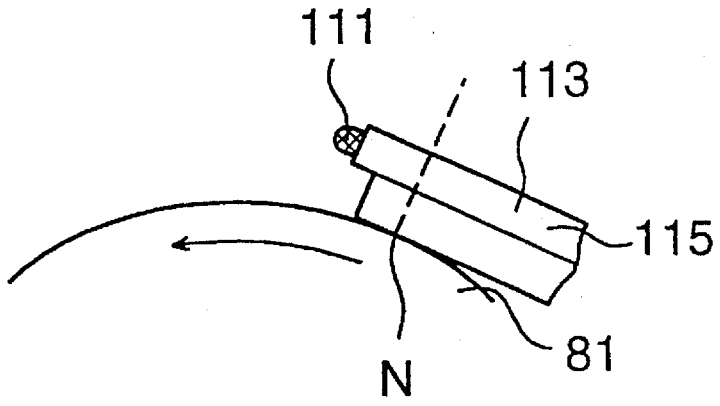
FIG. 36 is an arrangement view showing Example 6.

In this example, the conductive member was fixed so as to form a control electrode member. This example will be described with reference to FIGS. 35 and 36.

In this example, the same developing apparatus as that of Example 1 was used. The base plate 113 was made of a polyimide film. A tungsten wire, the diameter of which was 100 μm, was fixed to the fore end of the base plate 113 with adhesive 106 so as to form an electrode section. A reinforcing plate made of glass epoxy was used to form a control electrode (shown in FIG. 28). The control electrode was assembled to the developing apparatus in the manner shown in FIG. 29, and developing was carried out. As a result, a sufficient amount of developer was conveyed and images of high quality were provided.

Conventionally, a supporting member is adhered to the control electrode member in order to increase the mechanical strength. In this example, the electrode member is supported by the plate-shaped member, so that the conventional problem is not caused in which the wire is oscillated by the oscillating electric field and image quality is deteriorated.

As described above, in this example, the electrode section 111 was composed of a tungsten wire, the diameter of which was 0.1 mm. Thickness $l_5$ of the base plate was 0.15 mm. Thickness $l_6$ of the reinforcing member 115 was 0.20 mm. Distance $l_3$ between the electrode section 111 and the reinforcing member 115 was 0.1 mm. The entire thickness h including the reinforcing member 115 was 0.4 mm, but may be 0.35 mm.

According to the present invention, in the development technique in which toner particles are oscillated and scattered, a control electrode for use in a developing apparatus can be easily and accurately arranged in the developing region for scattering toner particles in the developing region. Also, a control electrode manufacturing method and a developing apparatus in which the control electrode is used can be provided.

What is claimed is:

1. A developing apparatus for developing an electrostatic latent image formed on an image retainer with developer, comprising:

(a) a developing sleeve, disposed to face the image retainer, for conveying the developer in a conveying direction to a developing region which is formed between the image retainer and the developing sleeve;

(b) a control electrode having a plate member of electrically insulated material disposed between the image retainer and the developing sleeve, and positioned upstream of a closest position of the image retainer and the developing sleeve in relation to the conveying direction of the developer, the plate member being arranged either to be brought into contact with or to be positioned adjacent to the developing sleeve;

an electrode member fixed to the plate member so that no portion of the electrode member extends upstream of a position where the plate member is in contact with or closest to the developing sleeve in relation to the conveying direction of the developer;

(c) first bias means for forming a first alternating electric field between the electrode member and the developing sleeve, wherein the following condition is satisfied:

$$1 \leqq R \cdot F/V \leqq 30$$

where R (mm) represents the length of the electrode member in the conveying direction of the developer, V (mm/s) represents the circumferential moving velocity of the developing sleeve, and F (Hz) represents the frequency of the first alternating electric field.

2. The apparatus of claim 1, wherein the electrode member has a part facing the image retainer, and the part is covered with the electrically insulated plate member.

3. The apparatus of claim 2, wherein a downstream end portion of the electrode member in relation to the conveying direction of the developer is covered with the electrically insulated plate member.

4. The apparatus of claim 1, wherein the electrode member comprises a wire fixed to a downstream end portion of the electrically insulated plate member in relation to the conveying direction of the developer.

5. The apparatus of claim 4, wherein the wire is covered with an electrically insulated material.

6. The apparatus of claim 1, wherein the electrode member comprises a metallic foil.

7. The apparatus of claim 1, wherein the electrode member comprises a conductive ink.

8. The apparatus of claim 1, wherein the electrode member has a thickness of 0.01 to 1.00 mm and a length of 0.03 to 2.00 mm.

9. The apparatus of claim 1, further comprising: second bias means for forming a second alternating electric field between the image retainer and the developing sleeve, wherein the second alternating electric field is weaker than the first alternating electric field.

10. The apparatus of claim 9, wherein both of the first alternating electric field and the second alternating electric field have the same phase.

11. A method of producing a control electrode in a developing apparatus for developing an electrostatic latent image formed on a image retainer with developer on a developing sleeve conveying the developer in a conveying direction to a developing region, the control electrode being positioned upstream of a closest position of the image retainer and the developing sleeve in relation to the conveying direction of the developer, a part of the control electrode being arranged either to be brought into contact with or to be adjacent to the developing sleeve, the method comprising the steps of:

(a) affixing an electrode member to a plate member of an electrically insulated material so that no portion of the electrode member extends upstream of a position where the control electrode is in contact with or closest to the developing sleeve in relation to the conveying direction of the developer; and (b) providing an insulated coating layer on the electrode member.

12. The method of claim 11, wherein the electrode member is a metallic foil.

13. The method of claim 12, further comprising the step of eliminating an unnecessary portion of the metallic foil through an etching processing.

14. The method of claim 11, wherein the electrode member is an electrically conductive ink.

15. The method of claim 11, wherein the electrode member is an electrically conductive material.

16. The method of claim 11, further comprising the step of attaching a reinforcement plate to the plate member.

17. The method of claim 16, wherein the reinforcement plate is not attached to a side of the plate member in an area opposite to where the electrode member is affixed.

18. A developing apparatus for developing an electrostatic latent image formed on an image retainer with developer, comprising:

(a) a developing sleeve, disposed to face the image retainer, for conveying the developer in a conveying direction to a developing region which is formed between the image retainer and the developing sleeve; and (b) a control electrode having a plate member of electrically insulated material disposed between the image retainer and the developing sleeve, and positioned upstream of a closest position of the image retainer and the developing sleeve in relation to the conveying direction of the developer, the plate member being arranged either to be brought into contact with or to be positioned adjacent to the developing sleeve, an electrode member fixed to the plate member so that the electrode member is positioned downstream of a position where the plate member is in contact with or closest to the developing sleeve in relation to the conveying direction of the developer, and first bias means for forming a first alternating electric field between the electrode member and the developing sleeve, wherein the following condition is satisfied:

$$1 \leqq R \cdot F/V \leqq 30$$

where R (mm) represents the length of the electrode member in the conveying direction of the developer, V (mm/s) represents the circumferential moving velocity of the developing sleeve, and F (Hz) represents the frequency of the first alternating electric field.

* * * * *